US008567329B2

(12) United States Patent
Kishi

(10) Patent No.: US 8,567,329 B2
(45) Date of Patent: Oct. 29, 2013

(54) SEWING APPARATUS AND COMPUTER-READABLE MEDIUM STORING PROGRAM FOR SEWING APPARATUS

(75) Inventor: Motoshi Kishi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 814 days.

(21) Appl. No.: 12/801,395

(22) Filed: Jun. 7, 2010

(65) Prior Publication Data

US 2010/0313805 A1 Dec. 16, 2010

(30) Foreign Application Priority Data

Jun. 12, 2009 (JP) ..... 2009-141010

(51) Int. Cl.
*D05B 19/12* (2006.01)
*D05B 69/10* (2006.01)

(52) U.S. Cl.
USPC ..... 112/470.04; 700/137

(58) Field of Classification Search
USPC ..... 112/470.01, 470.04, 154, 217.3, 217.4, 112/475.01, 475.17; 700/136, 138
See application file for complete search history.

(56) References Cited

U.S. PATENT DOCUMENTS 4,173,193 A * 11/1979 Morinaga et al. ..... 112/275
4,310,788 A * 1/1982 Hanyu et al. ..... 318/551
4,517,909 A * 5/1985 Neki et al. ..... 112/275
5,233,277 A * 8/1993 Kasig et al. ..... 318/551
5,477,795 A * 12/1995 Nakayama et al. ..... 112/277
5,886,490 A * 3/1999 Miller et al. ..... 318/561
2007/0256618 A1 11/2007 Hamajima
2008/0210147 A1* 9/2008 Hirose et al. ..... 112/470.06
2008/0229992 A1* 9/2008 Nakamura et al. ..... 112/470.03

FOREIGN PATENT DOCUMENTS

JP U-61-45080 3/1986
JP U-64-10425 1/1989
JP A-2006-34674 2/2006

* cited by examiner

*Primary Examiner* — Ismael Izaguirre
(74) *Attorney, Agent, or Firm* — Oliff & Berridge, PLC

(57) ABSTRACT

A sewing apparatus that includes a sewing device that performs sewing on a sewn object, a first operating device that is operative to input a command to execute an operation of the sewing device, a first detecting device that detects a preliminary operation state that is an operation state with respect to the first operating device that precedes an executing operation state, the executing operation state being an operation state for inputting the command to execute the operation of the sewing device, a notifying device that represents any one of at least two states that include a first state that corresponds to the preliminary operation state, and a control device that puts the notifying device into the first state in a case where the preliminary operation state is detected by the first detecting device.

20 Claims, 15 Drawing Sheets

FIG. 9

| CASE 1 (FOOT CONTROLLER IS CONNECTED) | | | | | |
|---|---|---|---|---|---|
| | OPERATION STATE WITH RESPECT TO FOOT CONTROLLER | | | OPERATION STATE WITH RESPECT TO BUTTON | |
| | NON-LOADING | PARTIALLY DEPRESSING | FULLY DEPRESSING | NOT PRESSING | PRESSING |
| LED STATE | ON | FLASH LED SLOWLY | FLASH LED RAPIDLY | ON | FLASH LED RAPIDLY |

| CASE 2 (FOOT CONTROLLER IS DISCONNECTED) | | | | | |
|---|---|---|---|---|---|
| | OPERATION STATE WITH RESPECT TO FOOT CONTROLLER | | | OPERATION STATE WITH RESPECT TO BUTTON | |
| | NON-LOADING | PARTIALLY DEPRESSING | FULLY DEPRESSING | NOT PRESSING | PRESSING |
| LED STATE | | | | OFF | FLASH LED RAPIDLY |

FIG. 10

NOTIFICATION MODIFIED EMBODIMENT 1

CASE 1 (FOOT CONTROLLER IS CONNECTED)

| | OPERATION STATE WITH RESPECT TO FOOT CONTROLLER | | | OPERATION STATE WITH RESPECT TO BUTTON | |
|---|---|---|---|---|---|
| | NON-LOADING | PARTIALLY DEPRESSING | FULLY DEPRESSING | NOT PRESSING | PRESSING |
| LED STATE | ON | FLASH LED SLOWLY | ON | ON | ON |

CASE 2 (FOOT CONTROLLER IS DISCONNECTED)

| | OPERATION STATE WITH RESPECT TO FOOT CONTROLLER | | | OPERATION STATE WITH RESPECT TO BUTTON | |
|---|---|---|---|---|---|
| | NON-LOADING | PARTIALLY DEPRESSING | FULLY DEPRESSING | NOT PRESSING | PRESSING |
| LED STATE | | | | OFF | OFF |

NOTIFICATION MODIFIED EMBODIMENT 2

CASE 1 (FOOT CONTROLLER IS CONNECTED)

| | OPERATION STATE WITH RESPECT TO FOOT CONTROLLER | | | OPERATION STATE WITH RESPECT TO BUTTON | |
|---|---|---|---|---|---|
| | NON-LOADING | PARTIALLY DEPRESSING | FULLY DEPRESSING | NOT PRESSING | PRESSING |
| LED STATE | GREEN | YELLOW | RED | GREEN | RED |

CASE 2 (FOOT CONTROLLER IS DISCONNECTED)

| | OPERATION STATE WITH RESPECT TO FOOT CONTROLLER | | | OPERATION STATE WITH RESPECT TO BUTTON | |
|---|---|---|---|---|---|
| | NON-LOADING | PARTIALLY DEPRESSING | FULLY DEPRESSING | NOT PRESSING | PRESSING |
| LED STATE | | | | OFF | RED |

SEWING APPARATUS AND COMPUTER-READABLE MEDIUM STORING PROGRAM FOR SEWING APPARATUS

CROSS-REFERENCE TO RELATED APPLICATION

This application claims priority to Japanese Patent Application No. 2009-141010, filed Jun. 12, 2009, the content of which is hereby incorporated herein by reference in its entirety.

BACKGROUND

The present disclosure relates to a sewing apparatus and a computer-readable medium that stores a program for a sewing apparatus.

During sewing, a user of a sewing apparatus performs an operation of placing a hand on a work cloth that serves as a sewn object, as well as other operations. Therefore, an operating member of the sewing apparatus is provided in an appropriate position. For example, a foot controller for starting the sewing apparatus is provided separately from the main body of the sewing apparatus, such that the user can operate the sewing apparatus by foot.

SUMMARY

With a known sewing apparatus, it sometimes happens that the user inadvertently operates the operating member.

Various exemplary embodiments of the broad principles derived herein provide a sewing apparatus and a computer-readable medium that stores a program for a sewing apparatus that provide notification of an operation state of a user with respect to an operating member.

Exemplary embodiments provide a sewing apparatus that includes a sewing device that performs sewing on a sewn object, a first operating device that is operative to input a command to execute an operation of the sewing device, a first detecting device that detects a preliminary operation state that is an operation state with respect to the first operating device that precedes an executing operation state, the executing operation state being an operation state for inputting the command to execute the operation of the sewing device, a notifying device that represents any one of at least two states that include a first state that corresponds to the preliminary operation state, and a control device that puts the notifying device into the first state in a case where the preliminary operation state is detected by the first detecting device.

Exemplary embodiments provide a computer-readable medium storing a sewing apparatus program. The program includes instructions that cause a controller to perform the steps of detecting a preliminary operation state that is an operation state with respect to a first operating device that is operative to input a command to execute an operation of a sewing device that performs sewing on a sewn object and is an operation that precedes an executing operation state for inputting the command to execute the operation of the sewing device, and putting a notifying device that represent any one of at least two states that include a first state that corresponds to the preliminary operation state into the first state in a case where the preliminary operation state is detected.

BRIEF DESCRIPTION OF THE DRAWINGS

Exemplary embodiments will be described below in detail with reference to the accompanying drawings in which:

FIG. 9 is an explanatory figure that shows correspondences between notification patterns and operation states;

FIG. 10 is an explanatory figure that shows correspondences between notification patterns and operation states in a modified example;

DETAILED DESCRIPTION

Figure 1:
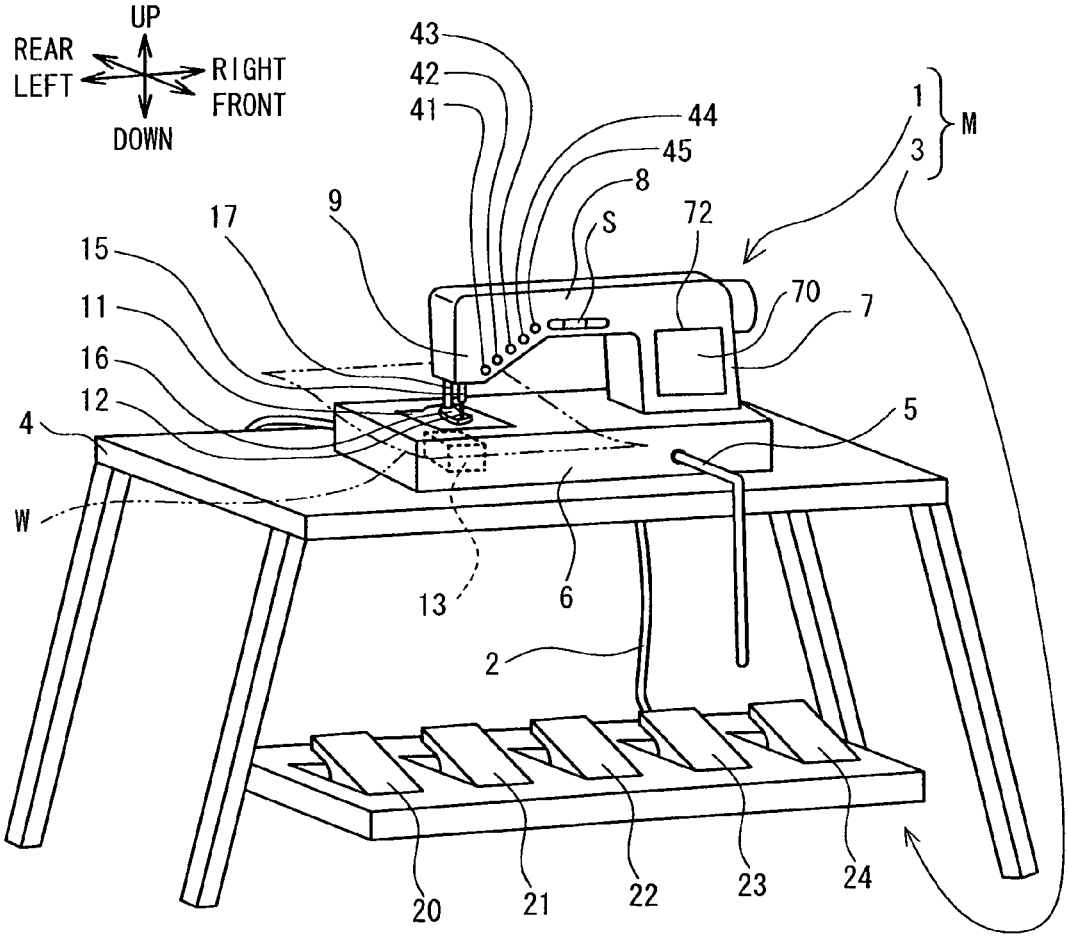
FIG. 1 is an explanatory figure that shows an arrangement of a household-use sewing machine, a foot controller, and a table.

As shown in FIG. 1, a sewing apparatus M is provided with a household-use sewing machine (hereinafter simply called the sewing machine) 1 and a foot controller 3. The foot controller 3 is removably connected to the sewing machine 1 through a cable 2.

The sewing machine 1 is placed on a table 4 as necessary, and the foot controller 3 is placed underneath the table 4. That is, the sewing machine 1 is positioned above the foot controller 3. A user can perform operations by hand above the table 4. The operations by hand are, for example, an operation that holds down on a work cloth W that serves as a sewn object, an operation of placing a hand on the work cloth W, an operation of moving the work cloth W, and operations on the sewing machine 1. The user can also operate the sewing machine 1 by operating the foot controller 3 by foot (indicated by broken lines in FIG. 2) underneath the table 4, without using the hands. In addition, a knee lifter bar 5 that is provided on the front of the sewing machine 1 extends downward below the top of the table 4 in order for the user to operate the sewing machine 1 using a knee, without using the hands.

The sewing machine 1 includes a bed 6, a pillar 7, an arm 8, and a head 9. The pillar 7 is provided such that it rises upward from the right end of the bed 6. The arm 8 extends to the left from the upper end of the pillar 7, such that it is opposite the bed 6. The head 9 is the end portion of the arm 8. The bed 6, the pillar 7, the arm 8, and the head 9 are each a portion of a housing for the sewing machine 1 that covers internal mechanisms. The housing may be formed from plastic, for example. The side of the housing where the user who operates the sewing machine 1 is positioned is referred to as the front side, while the opposite side is referred to as the rear side. The side where the pillar 7 is positioned is referred to as the right side, and the opposite side is referred to as the left side.

The work cloth W is disposed on the top face of the bed 6 during sewing. A needle plate 11 is disposed on the top face of the bed 6, such that it is positioned underneath the work cloth W. A through-hole portion (not shown in the drawings) through which a needle 12 passes in the up and down directions is formed in the needle plate 11. A shuttle mechanism 13 is provided underneath the needle plate 11. The shuttle mechanism 13 forms a stitch by operating in conjunction with the needle 12 that moves up and down. A needle bar 15 and a presser bar 17 are provided in the head 9, which is positioned above the shuttle mechanism 13. The needle 12 is removably mounted in the needle bar 15. A presser foot 16 is removably mounted in the presser bar 17. The presser foot 16 presses from above on the work cloth W, which is disposed on the top face of the needle plate 11. An area around where the needle 12 moves up and down (below the head 9) is an area that, as a sewing position, is an object of the attention of the user of the sewing machine 1 during sewing.

In addition to the configuration that is described above, mechanisms that will be described below are provided in the sewing machine 1 as general mechanisms that are necessary for sewing. A feed mechanism and a thread cutting mechanism are provided in the bed 6. The feed mechanism moves the work cloth W in relation to the needle 12 and the shuttle mechanism 13. The thread cutting mechanism cuts the thread that is supplied to the needle 12. A needle bar up-and-down mechanism, a needle bar swinging mechanism, a thread take-up lever mechanism, and a presser bar up-and-down mechanism are provided in the head 9. The needle bar up-and-down mechanism moves the needle bar 15 up and down. The needle bar swinging mechanism swings the needle bar 15 in the left and right directions. The thread take-up lever mechanism pulls up the thread that is supplied to the needle 12. The presser bar up-and-down mechanism moves the presser bar 17 up and down. As described above, various mechanisms that are used for sewing are contained in the interior of a housing of the sewing machine, which is positioned above the foot controller 3. Sewing operations can be performed at positions apart from an operating device such as the foot controller 3 and from an operating member such as the knee lifter bar 5, which can be operated by the user's foot and knee, respectively, instead of by the user's hand.

Figure 2:
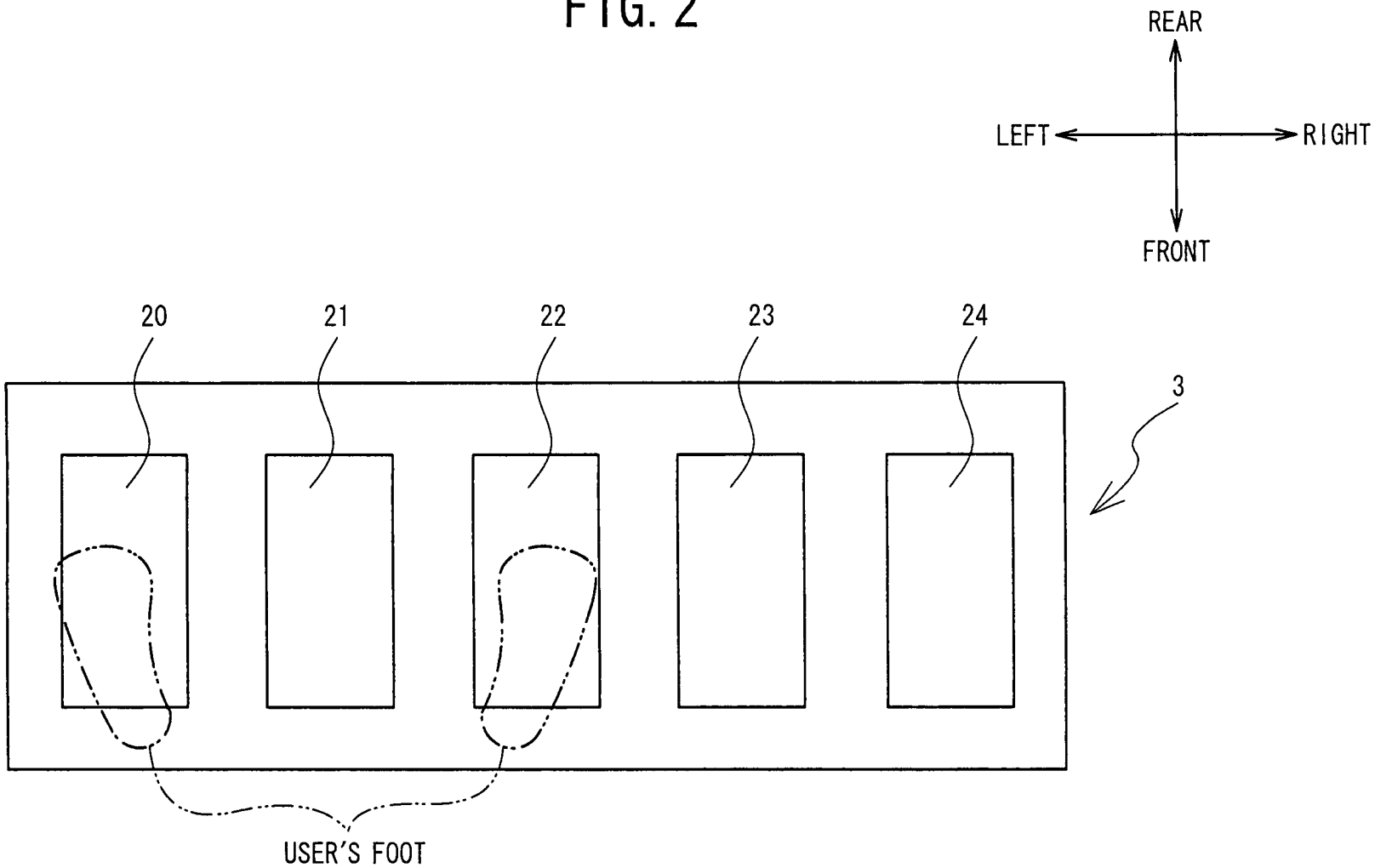
FIG. 2 is a plan view of the foot controller.

The foot controller 3 has a housing that is separate from that of the sewing machine 1. The foot controller 3 is electrically connected through the cable 2 to a jack 18 (refer to FIG. 3) that is provided in the sewing machine 1. As shown in FIG. 2, five rotatable pedals 20 to 24 are disposed in the housing of the foot controller 3. Each of the pedals 20 to 24 is operated individually in order to input to the sewing machine 1 commands for performing sewing operations that differ according to the pedal that is operated.

The pedal 20, which is the farthest to the left, is operated in order to input commands to start and stop sewing, as well as commands to increase and decrease the sewing speed. The pedal 21, which is the second from the left, is operated in order to input a command to switch the vertical position of the needle 12. The pedal 22, which is the third from the left, is operated in order to input a command to reverse the sewing direction and sew a reverse stitch. The pedal 23, which is the fourth from the left, is operated in order to input a command to cut the thread in the needle 12. The pedal 24, which is the fifth from the left, is operated in order to input a command to switch the vertical position of the presser bar 17. In other words, the pedal 22 for reverse stitching is disposed in the left-right direction between the pedal 21 for switching the vertical position of the needle 12 and the pedal 23 for cutting the thread. The arrangement of the three pedals 21 to 23 allows the user, while performing the sewing, to keep one foot on standby on the pedal 22 that is positioned in the middle. By moving the foot away from the pedal 22 and thoroughly depressing (a fully depressing state mentioned bellow) the pedal 21, as necessary, the user switches the vertical position of the needle 12. By moving the foot away from the pedal 22 and depressing the pedal 23, as necessary, the user cuts the thread supplied to the needle 12. In other words, the five pedals 20 to 24 are arranged in a specified order such that they can be easily operated by the user's feet. The pedal 22 that serves as the operating member for inputting the command to sew the reverse stitch is positioned between the pedal 21 that serves as the operating member for inputting the command to switch the needle position and the pedal 23 that serves as the operating member for inputting the command to cut the thread.

Figure 3:
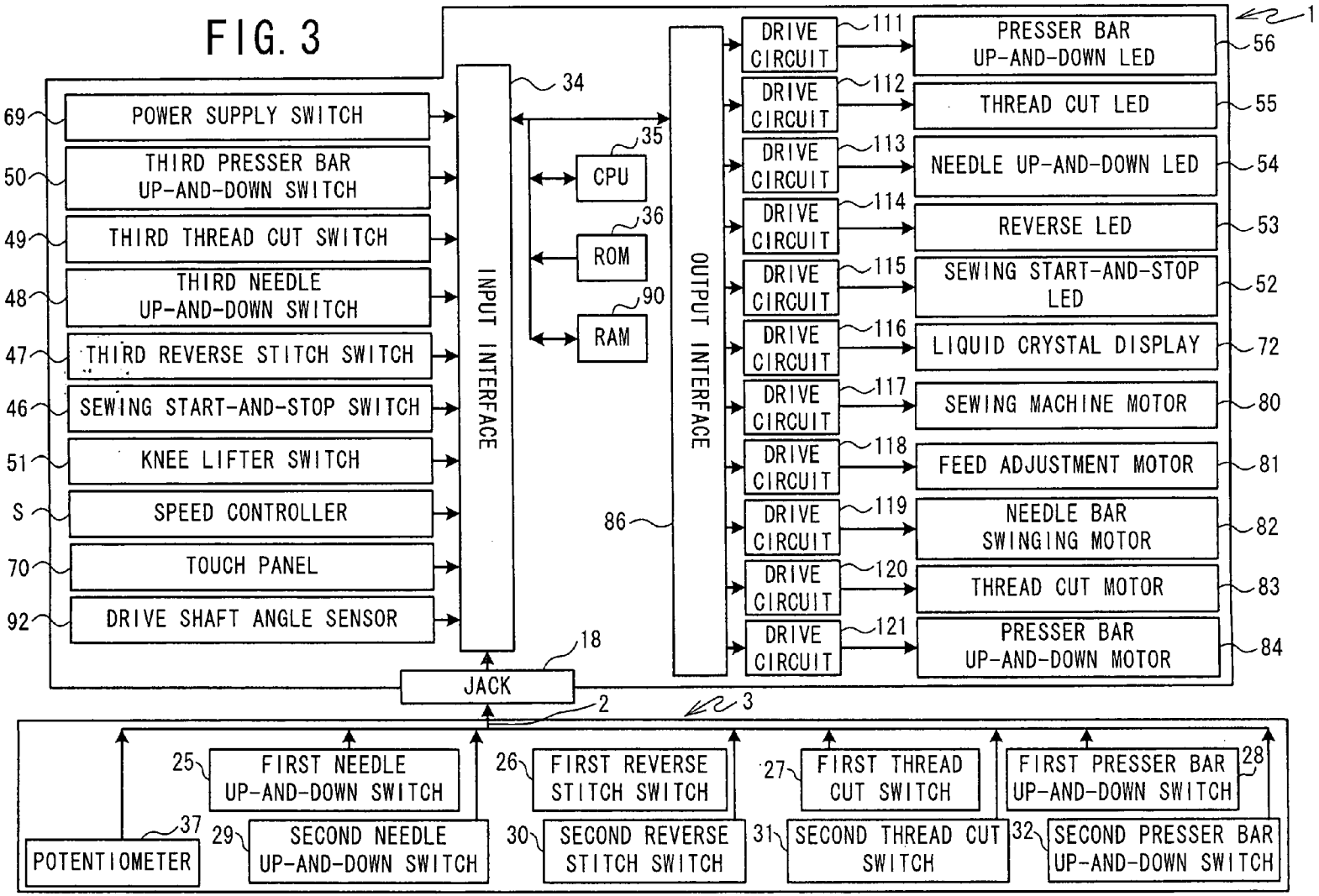
FIG. 3 is a block diagram that shows an electrical configuration of a sewing apparatus.

As shown in FIG. 3, eight switches 25 to 32 and a potentiometer 37 are disposed in the interior of the housing of the foot controller 3 for electrically detecting the operation states of the user with respect to the each of the five pedals 20 to 24 that are described above. The detection results from the switches 25 to 32 are electrically transmitted through the cable 2 to the sewing machine 1 and are input through an input interface 34 to a CPU 35 that is a control device. Removing the cable 2 from the jack 18 makes it possible to put the foot controller 3 (the pedals 20 to 24) into a dormant state in which a partially depressing state that serves as a preliminary operation state and the fully depressing state that serves as an executing operation state are not detected. The preliminary operation state is any operation state that precedes the executing operation state. A program by which the CPU 35 detects whether the foot controller 3 is in the dormant state is stored in a ROM 36.

Figure 4:
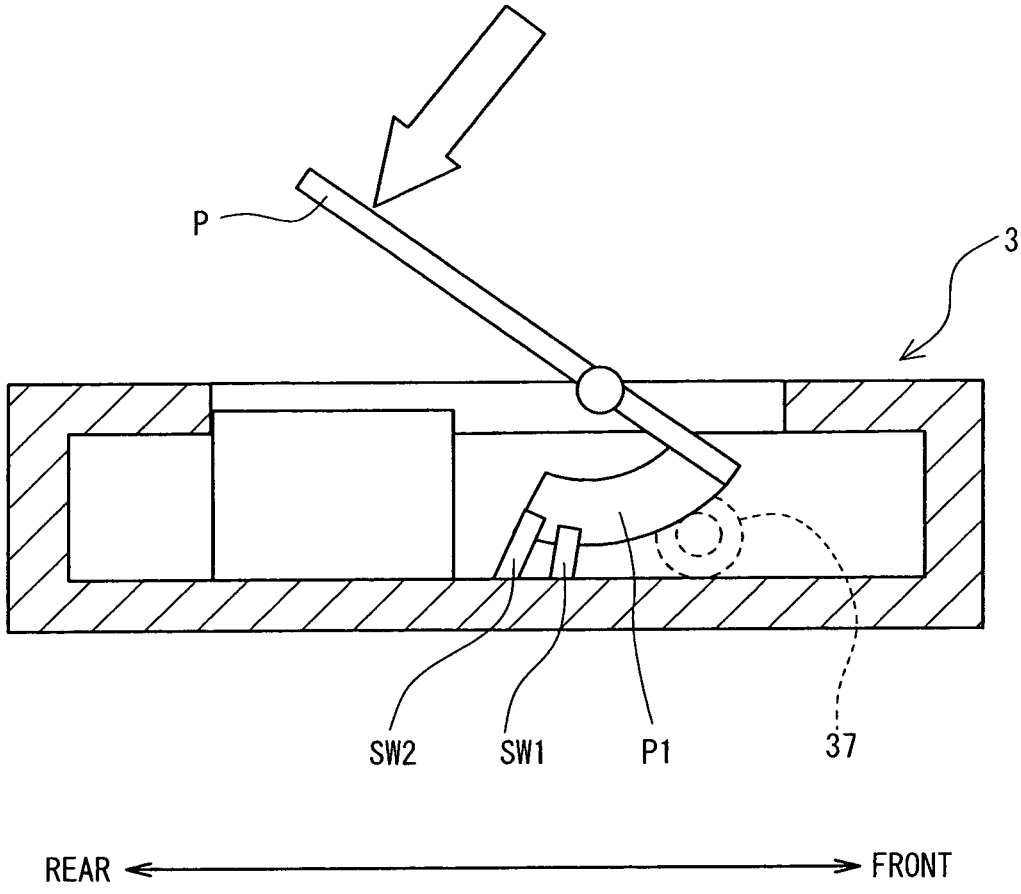
FIG. 4 is an explanatory figure that explains detection of an operation state with respect to the foot controller (a non-loading state)
Figure 5:
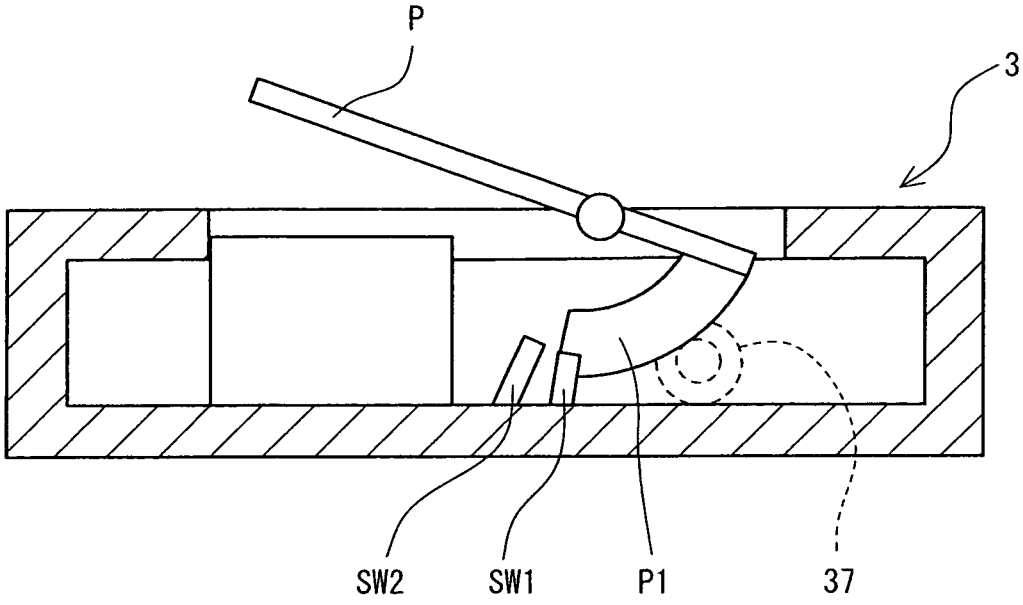
FIG. 5 is an explanatory figure that explains detection of an operation state with respect to the foot controller (a partially depressing state where the user is partially depressing the foot controller)
Figure 6:
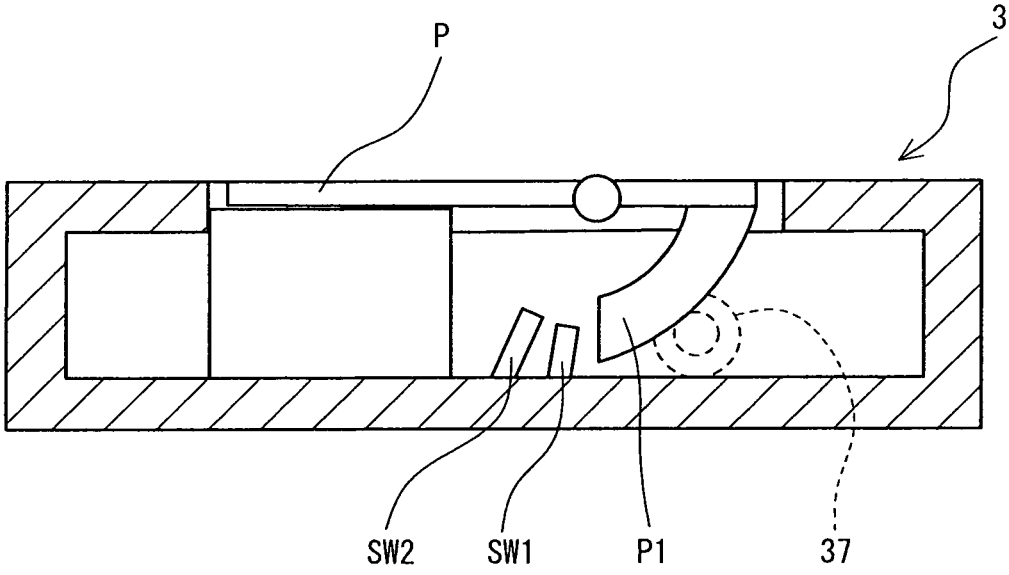
FIG. 6 is an explanatory figure that explains detection of an operation state with respect to the foot controller (a fully depressing state where the user is fully depressing the foot controller)

An overview of the detecting of the states of the pedals 21 to 24 by the switches 25 to 32 will be explained with reference to FIGS. 4 to 6. As shown in FIG. 4, two switches, SW1 and SW2, are disposed in the vicinity of a rotating range of a pedal P. When an operation state of the user is a non-loading state, in which the user is not depressing the pedal P with a foot, the switches SW1 and SW2 are blocked by a fan-shaped portion P1 on the underside of the pedal P and are thus turned off. When the user depresses the pedal P with a foot, a load bears on the pedal P in the counterclockwise direction in FIG. 4, such that the pedal P rotates in the counterclockwise direction. When the operation state with respect to the pedal P changes from the non-loading state to the partially depressing state, in which the user is partially depressing the pedal P to rotate to a partially depressing angle that is at least a first specified angle and less than a second specified angle, as shown in FIG. 5, the fan-shaped portion P1 is separated from the switch SW2, and the switch SW2 changes from off to on. At this time, the switch SW1 is still off. When the user depresses the pedal P farther with a foot, the pedal P rotates farther in the counterclockwise direction from the state that is shown in FIG. 5. When the operation state changes from the partially depressing state to the fully depressing state in which the user is fully depressing the pedal P to rotate to a fully depressing angle that is at least the second specified angle, as shown in FIG. 6, the fan-shaped portion P1 is separated from the switch SW1, and the switch SW1 changes from off to on, while the switch SW2 stays on.

Thus the switch SW2 is a device for electrically detecting that the pedal P has been rotated counterclockwise to the partially depressing angle from an angle corresponding to the non-loading state that is shown in FIG. 4 (corresponding to the partially depressing state), as shown in FIG. 5. In other words, the switch SW2 detects the operation state of the user with respect to the pedal P before it reaches the second half of its counterclockwise rotating range, thus providing information on the operation state with respect to the pedal P to the CPU 35. The switch SW1 electrically detects that the pedal P has been rotated farther counterclockwise to the fully depressing angle from the partially depressing angle, and that the pedal P is in the second half of its counterclockwise rotating range (corresponding to the fully depressing state), as shown in FIG. 6. The switch SW1 thus provides information on the operation state of the user with respect to the pedal P to the CPU 35. An operation state for inputting a command to the sewing machine 1 to perform a sewing operation is called an executing operation state. The fully depressing state with respect to the pedal P serves as an executing operation state, for example. An operation state that precedes an executing operation state is called a preliminary operation state. That is, the preliminary operation state defined herein is an operation state that is expected to change to the executing operation state. Thus, the preliminary operation state includes an operation state in which the user inadvertently or purposefully operates or moves with respect to the operation member before inputting command. The partially depressing state with respect to the pedal P serves as a preliminary operation state, for example.

The switches that are described below are provided in the interior of the housing of the foot controller 3 in order to detect the fully depressing state in the same manner as the switch SW1. A first needle up-and-down switch 25 is provided for the pedal 21, which is the second from the left. A first reverse stitch switch 26 is provided for the pedal 22, which is the third from the left. A first thread cut switch 27 is provided for the pedal 23, which is the fourth from the left. A first presser bar up-and-down switch 28 is provided for the pedal 24, which is the fifth from the left. The switches that are described below are provided in the interior of the housing of the foot controller 3 in order to detect the partially depressing state in the same manner as the switch SW2. A second needle up-and-down switch 29 is provided for the pedal 21, which is the second from the left. A second reverse stitch switch 30 is provided for the pedal 22, which is the third from the left. A second thread cut switch 31 is provided for the pedal 23, which is the fourth from the left. A second presser bar up-and-down switch 32 is provided for the pedal 24, which is the fifth from the left. The switches 29 to 32 detect that the pedals 20 to 24, respectively, are rotated counterclockwise to the partially depressing angle (i.e., in the partially depressing state), as shown in FIG. 5, thus providing information on the operation states with respect to the pedals 20 to 24 to the CPU 35. In contrast, the switches 25 to 28 detect that the pedals 20 to 24, respectively, are rotated counterclockwise to the fully depressing angle (i.e., in the fully depressing state), as shown in FIG. 6, thus providing information on the operation states with respect to the pedals 20 to 24 to the CPU 35.

For the pedal 20, which is the farthest to the left, no switch is provided solely for the purpose of detecting the partially depressing state in the same manner as the switch SW2. The potentiometer 37 is provided in the interior of the housing of the foot controller 3 as a member that fulfills the roles of both the switch SW2 and the switch SW1 for detecting the angle of rotating from the angle corresponding to the non-loading state with respect to the pedal 20, which is the farthest to the left. The detection result from the potentiometer 37 is electrically transmitted through the cable 2 to the sewing machine 1 and is input to the CPU 35 through the input interface 34. Thus the potentiometer 37 detects that the pedal 20, which is the farthest to the left, has been rotated counterclockwise to the specified angle from the angle corresponding to the non-loading state that is shown in FIG. 4, and that the pedal 20 has been rotated to the partially depressing angle (corresponding to the partially depressing state), as shown in FIG. 5. Then the potentiometer 37 provides this information on the pedal 20 to the CPU 35. Furthermore, in a case where the pedal 20 has been rotated counterclockwise more than the second specified angle, the CPU 35 performs speed control that is proportional to the angle of rotating from the angle corresponding to the non-loading state.

As shown in FIG. 1, in the sewing machine 1, five buttons 41 to 45 are provided as various types of operating members on the front face of the head 9, which is closer to the sewing position than is the foot controller 3. The knee lifter bar 5 is provided on the front face of the bed 6, which is farther away from the sewing position than is the head 9. Switches 46 to 50 (refer to FIG. 3) are provided behind the five buttons 41 to 45 in the head 9 in order to detect pressing of the buttons 41 to 45, respectively. A knee lifter switch 51 (refer to FIG. 3) is provided in the vicinity of the knee lifter bar 5 in order to detect turning of the knee lifter bar 5. Signals that are generated when the switches 46 to 51 are operated by the operating of the buttons 41 to 45 and the knee lifter bar 5 are input to the CPU 35 through the input interface 34. An operation state in which the user presses any one of the buttons 41 to 45, as well as an operation state in which the user turns the knee lifter bar 5, serves as an executing operation state.

The order in which the five buttons 41 to 45 are arranged is set such that they are easy for the user to operate around the head 9. Between the arrangement of the five buttons 41 to 45 and the arrangement of the pedals 20 to 24 in the foot controller 3, the left-to-right orders of the operating members for inputting the command for the reverse stitch and the operating members for inputting the command to switch the vertical position of the needle 12 are different. Specifically, among the five buttons 41 to 45 on the front face of the head 9, the button 41 is the farthest to the left, as shown in FIG. 1, and it is the button that is operated in order to input the commands to start and stop sewing. The button 42 is the second from the left, and it is the button that is operated in order to input the command to reverse the sewing direction to sew a reverse stitch. The button 43 is the third from the left, and it is the button that is operated in order to input the command to switch the vertical position of the needle 12. The button 44 is the fourth from the left, and it is the button that is operated in order to input the command to cut the thread supplied to the needle 12. The button 45 is the fifth from the left, and it is the button that is operated in order to input the command to switch the vertical position of the presser bar 17. A speed controller S is provided to the right of the five buttons 41 to 45. The speed controller S is operated in order to input commands to increase and decrease the sewing speed. The various types of the buttons 41 to 45 and the speed controller S are disposed higher than the pedals 20 to 24 in the foot controller 3 and higher than the knee lifter bar 5, and closer to the sewing position than are the pedals 20 to 24 in the foot controller 3 and the knee lifter bar 5.

The buttons 41 to 45 are plastic members through which light passes, and they are disposed such that they can be moved in the front-to-rear direction. Light-emitting members (LEDs) 52 to 56 (refer to FIG. 3) are disposed in the interiors of the buttons 41 to 45, respectively. The LED 52 is in the interior of the button 41. The LED 53 is in the interior of the button 42. The LED 54 is in the interior of the button 43. The LED 55 is in the interior of the button 44. The LED 56 is in the interior of the button 45. When one of the buttons 41 to 45 is pressed, the switch that, among the switches 46 to 50, is disposed to the rear of the pressed button is turned on. The buttons 41 to 45 are arranged such that, in a case where the LEDs 52 to 56 are emitting light, the user can confirm, at a position that is close to the sewing position, that the light is passing through the buttons 41 to 45. A program that the CPU 35 executes is configured such that, when one of the buttons 41 to 45 is pressed, the light-emitting state of the one of the LEDs 52 to 56 that is in the interior of the pressed button becomes a state that corresponds to an operation. Specifically, as shown in FIG. 9, in a case 1 where the foot controller 3 and the sewing machine 1 are connected, the light-emitting state of each of the LEDs 52 to 56 follows a sequence of turning on, then temporarily flashing rapidly, then turning on again. In a case 2 where the foot controller 3 and the sewing machine 1 are disconnected, the light-emitting state of each of the LEDs 52 to 56 follows a sequence of turning off, then temporarily flashing rapidly, then turning off again. In other words, the LEDs 52 to 56 are provided in correspondence to the buttons 41 to 45. The light-emitting state of each of the LEDs 52 to 56 that corresponds to an executing operation state with respect to each of the buttons 41 to 45 is rapid flashing.

A power supply switch 69 that is shown in FIG. 3 is a switch for turning on the power supply to the sewing machine 1. A touch panel 70 for selecting a sewing pattern and a liquid crystal display 72 are provided in the sewing machine 1. Various types of motors 80 to 84, the LEDs 52 to 56, and the liquid crystal display 72 are provided in the sewing machine 1. Drive circuits 111 to 121 for the motors 80 to 84, the LEDs 52 to 56, and the liquid crystal display 72 are also provided in the sewing machine 1. Each of the drive circuits 111 to 121 is controlled by the CPU 35 through an output interface 86 in accordance with a program that is stored in the ROM 36. In addition, a RAM 90 that is used in control processing is electrically connected to the CPU 35. A drive shaft angle sensor 92 for detecting the vertical position of the needle 12 is electrically connected to the CPU 35 through the input interface 34.

Figure 7:
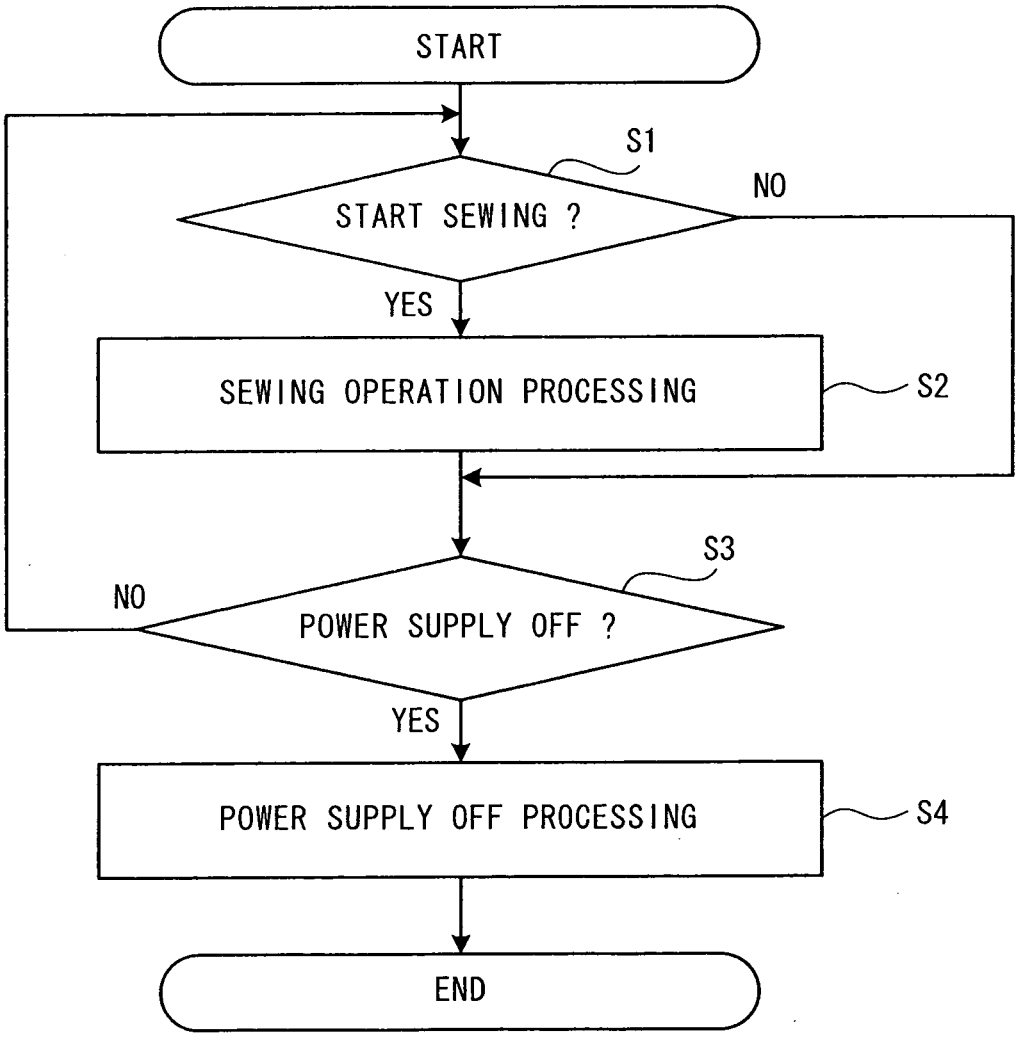
FIG. 7 is a flowchart of a main routine in the household-use sewing machine.

An overview of control that is shown in FIG. 7 will be explained. A determination is made as to whether a sewing start command has been input (Step S1). In a case where the power supply switch 69 has been turned on and the user has input the sewing start command by operating one of the pedals 20 to 24, the buttons 41 to 45, and the knee lifter bar 5, a determination is made that the sewing start command has been input (YES at Step S1). In that case, the CPU 35 performs sewing operation processing (Step S2). In a case where the sewing start command has not been input (NO at Step S1), as well as in a case where the power supply switch 69 has been turned off after the processing at Step S2 (YES at S3), the CPU 35 performs power supply off processing (Step S4). The processing is then terminated. In a case where the power supply switch 69 has been turned off (NO at S3), the processing returns to Step S1.

In the sewing operation processing (Step S2), the CPU 35 performs control as described below in accordance with a program that is stored in the ROM 36.

When the user, to start sewing, performs one of an operation of fully depressing the pedal 20 at least a specified amount and an operation of pressing the button 41, the processing that is described below is performed. A specified signal is generated by one of the potentiometer 37 and a sewing start-and-stop switch 46, depending on which of the operating members the user has operated. When the CPU 35 detects the signal, the CPU 35 outputs to a drive circuit a command for sewing a selected stitching pattern. In concrete terms, the CPU 35, through the drive circuit 117, controls a sewing machine motor 80 such that it drives the shuttle mechanism 13, the needle bar up-and-down mechanism, the thread take-up lever mechanism, and the like. Through the drive circuit 118, the CPU 35 controls a feed adjustment motor 81 such that it drives the feed mechanism. Through the drive circuit 119, the CPU 35 controls a needle bar swinging motor 82 such that it drives the needle bar swinging mechanism.

When the user, to switch the vertical position of the needle 12, as a sewing operation, performs one of the full depressing of the pedal 21 and the pressing of the button 43, the processing that is described below is performed. A specified signal is generated by one of the first needle up-and-down switch 25 and a third needle up-and-down switch 48, depending on which of the operating members the user has operated. When the CPU 35 detects the signal, the CPU 35, through the drive circuit 117, controls the sewing machine motor 80 such that it drives and stops the needle bar up-and-down mechanism in accordance with detection results from the drive shaft angle sensor 92.

When the user, to sew a reverse stitch, as a sewing operation, performs one of the full depressing of the pedal 22 and the pressing of the button 42, the processing that is described below is performed. A specified signal is generated by one of the first reverse stitch switch 26 and a third reverse stitch switch 47, depending on which of the operating members the user has operated. When the CPU 35 detects the signal, the CPU 35, through the drive circuit 117, controls the sewing machine motor 80 such that it drives the shuttle mechanism 13, the thread take-up lever mechanism, and the needle bar up-and-down mechanism. Through the drive circuit 118, the CPU 35 controls the feed adjustment motor 81 such that it drives the feed mechanism. Through the drive circuit 119, the CPU 35 controls the needle bar swinging motor 82 such that it drives the needle bar swinging mechanism.

When the user, to cut the thread, as a sewing operation, performs one of the full depressing of the pedal 23 and the pressing of the button 44, the processing that is described below is performed. A specified signal is generated by one of the first thread cut switch 27 and a third thread cut switch 49, depending on which of the operating members the user has operated. When the CPU 35 detects the signal, the CPU 35, through the drive circuit 120, controls a thread cut motor 83 such that it drives the thread cutting mechanism.

When the user, to switch the vertical position of the presser foot 16, as a sewing operation, performs one of the full depressing of the pedal 24, the pressing of the button 45, and the turning of the knee lifter bar 5, the processing that is described below is performed. A specified signal is generated by one of the first presser bar up-and-down switch 28 a third presser bar up-and-down switch 50, and the knee lifter switch 51, depending on which of the operating members the user has operated. When the CPU 35 detects the signal, the CPU 35, through the drive circuit 121, controls a presser bar up-and-down motor 84 such that it drives the presser bar up-and-down mechanism. The knee lifter switch 51 transmits a user command to the CPU 35 in the same manner as does the third presser bar up-and-down switch 50. The driving of the presser bar up-and-down mechanism by the presser bar up-and-down motor 84 moves the presser foot 16 vertically.

Figure 8:
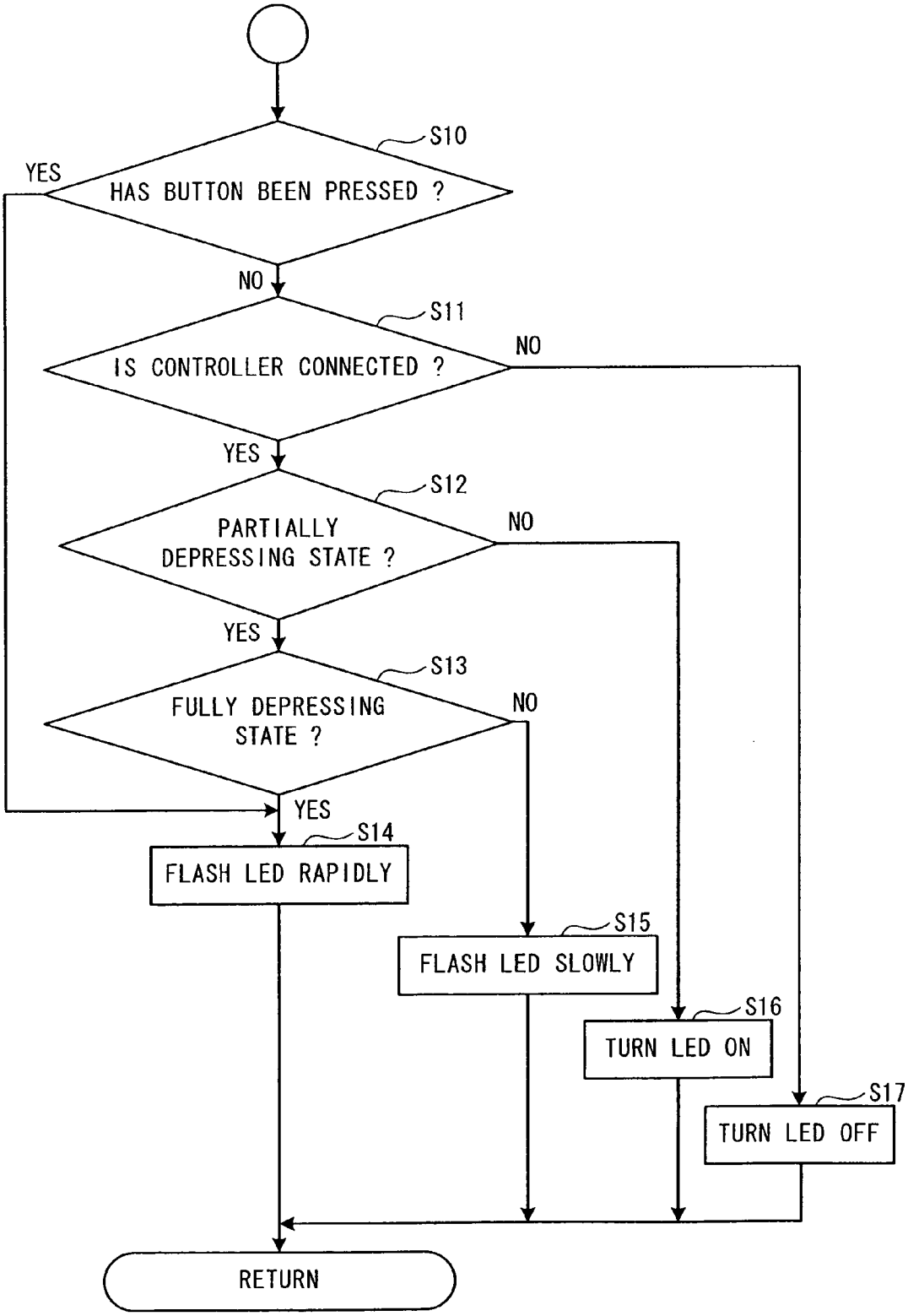
FIG. 8 is a flowchart of switching processing for an LED in the household-use sewing machine.

In conjunction with the sewing operations that are described above, the CPU 35, in order to control the LEDs 52 to 56, performs interrupt processing that is shown in FIG. 8 for a specified extremely short time interval, in accordance with a program that is stored in the ROM 36. The interrupt processing in FIG. 8 controls the light emitting states of the LEDs 52 to 56 in accordance with correspondences between notification patterns in FIG. 9 and operation states that include the operation states with respect to the operating members.

Assume that a case exists in which none of the buttons 41 to 45 and the like that input the commands to execute the sewing operations of the sewing machine 1 has been pressed (NO at Step S10) and the foot controller 3 is connected to the sewing machine 1 (YES at Step S11). In that case, if the user partially depresses one of the unloaded pedals 21 to 24, the switch SW1 and the switch SW2 that correspond to the partially depressed pedal stay off and turn on, respectively, and the CPU 35 detects the partial depressing state with respect to the pedal (YES at Step S12; NO at Step S13). In this case, the CPU 35 controls the light emitting state of the one of the LEDs 53 to 56 that corresponds to the partially depressed pedal such that the light emitting state changes from on to slow flashing (Step S15). If the user further depresses (fully depresses) the pedal from the partially depressing state, the switch SW1 and the switch SW2 that correspond to the fully depressed pedal turn on and stay on, respectively, and the CPU 35 detects the fully depressing state with respect to the pedal (NO at Step S10; YES at Step S11; YES at Step S12; YES at Step S13). In this case, the CPU 35 controls the switching of the light emitting state of the one of the LEDs 53 to 56 that corresponds to the fully depressed pedal such that the light emitting state changes from slow flashing to rapid flashing (Step S14).

For the pedal 20, the potentiometer 37 outputs a signal that corresponds to the angle of rotating from the angle corresponding to the non-loading state with respect to the pedal 20. Based on the output signal, the CPU 35 determines whether the operation state of the user is one of the partially depressing state and fully depressing state, in the same manner as it does for the pedals 21 to 24, and performs control of the light emitting state of the LED 52 in the same manner as it controls the LEDs 53 to 56.

In contrast, assume that a case exists in which, in a state in which none of the pedals 20 to 24 and none of the buttons 41 to 45 is being operated, the user presses one of the buttons 41 to 45 on the sewing machine 1 (YES at Step S10). In that case, the CPU 35 controls the switching of the light emitting state of the one of the LEDs 52 to 56 that corresponds to the pressed button such that the light emitting state changes from on to rapid flashing (Step S14). Alternatively, assume that a case exists in which the user does not press any of the buttons 41 to 45 and does not depress any of the pedals 20 to 24, even if the foot controller 3 is connected to the sewing machine 1 (NO at Step S10; YES at Step S11; NO at Step S12). In that case, the CPU 35 controls the LEDs 52 to 56 such that they are all in the on state (Step S16). Assume that a case exists in which the user does not press any of the buttons 41 to 45 (NO at Step S10) and the foot controller 3 is not connected to the sewing machine 1 (NO at Step S11). In that case, the CPU 35 controls the switching of the light emitting states of the LEDs 52 to 56 such that all of the LEDs 52 to 56 are in the off state (Step S17), until any one of the buttons 41 to 45 is pressed (YES at Step S10).

According to the configuration that is described above, the user's partial depressing of one of the pedals 20 to 24 causes the CPU 35 to put the corresponding one of the LEDs 52 to 56 into the state (slow flashing) that corresponds to a preliminary operation state (the partially depressing state). The control of the light emitting states of the LEDs 52 to 56 displays a visual warning to the user and prevents inadvertent operation of the pedals 20 to 24. The foot controller 3 is disposed underneath the table 4, at a remove from the sewing position. Therefore, if the user of the sewing apparatus M is focusing attention on a sewing operation of the sewing machine 1 (for example, up and down motion of the needle 12), the foot controller 3 tends not to be in the user's field of view. The sewing apparatus M can use the light emitting states of the LEDs 52 to 56 to notify the user of the operation states (non-loading state, partially depressing state, fully depressing state) with respect to the pedals 20 to 24 in the foot controller 3, as well as whether the foot controller 3 is connected to the sewing machine 1. As shown in FIG. 9, the light emitting states that correspond to the operation states with respect to the pedals 20 to 24 and to the presence and absence of the foot controller 3 are on, rapid flashing, slow flashing, and off. Therefore, the sewing apparatus M can prevent the user from inadvertently operating the pedals 20 to 24.

As a modified embodiment of the notification in contrast to the configuration that is described above, the notification may be provided only for the partial depressing of any one of the pedals 20 to 24, which is equivalent to a preliminary operation state. For example, in a state in which the user is fully depressing one of the pedals 20 to 24, which is equivalent to an executing operation state, the state of the notification may be the same as when the operation state with respect to the same one of the pedals 20 to 24 is the non-loading state (refer to Notification Modified Embodiment 1 in FIG. 10). In Notification Modified Embodiment 1 in FIG. 10, the LED light emitting state that corresponds to the state in which the user is fully depressing one of the pedals 20 to 24, which is equivalent to the executing operation state, is the on state, which is the same as the LED light emitting state that corresponds to the non-loading state with respect to the pedals 20 to 24.

As another modified embodiment, the notification of the operation state with respect to the foot controller 3 may also be provided in the form of a color by using, as the light source that serves as the notification member, an LED that emits colored light instead of a white LED that emits white light (refer to Notification Modified Embodiment 2 in FIG. 10). In Notification Modified Embodiment 2 in FIG. 10, the color of the LED that emits the light is controlled according to the operation state with respect to the foot controller 3 and the operation states with respect to the buttons 41 to 45, as well as according to whether the foot controller 3 is connected to the sewing machine 1. According to the configuration that is described above, in a case, for example, where a foreign object that is not shown in the drawings is in contact with or close to one of the pedals 20 to 24 that serve as the operating members, the presence of the foreign object would be detected as a preliminary operation state, so notification of the presence of the foreign object would be provided to the user. In that case, the user would know of the presence of the foreign object.

The sizes of the head 9 (at least the bottom portion of the front face of the head 9) and the arm 8, as parts of the sewing machine 1 that are located in the vicinity of the sewing position, are limited by the need to ensure space for the user to move and hold down the sewn object by hand while sewing. At the same time, as parts that are located in the vicinity of the sewing position, which is the focus of the user's attention, the head 9 and the arm 8 are well-suited for operation and notification. Therefore, numerous members such as the start-and-stop button 41, mechanisms for providing notification and the like are already provided on the front face of the head 9 and the arm 8. The LEDs 52 to 56 that are described above are used to provide notifications for both preliminary operation states of the user and dormant states of operating devices (for example, the disconnected state of the foot controller 3) by having their light emitting states switched. The LEDs 52 to 56 are provided inside the buttons 41 to 45. Therefore, both kinds of notifications can be provided on the front face of the head 9 and the arm 8, whose sizes are limited, in a position that is readily visible to the user and that does not require the addition of a new space.

It is desirable for the pedal 22 in the foot controller 3 that inputs the command to sew a reverse stitch, as described above, to be disposed between the pedal 21 that inputs the command to change the needle position and the pedal 23 that inputs the command to cut the thread. During sewing, it is desirable from the standpoint of the sewing operation for the user's foot to be on standby on the pedal 22. On the other hand, considering the operability of operations by the user's hand, the operation buttons are arranged in the order of the start-and-stop button 41, the reverse stitch button 42, the needle position operation button 43, the thread cut button 44, and the presser foot up-and-down button 45 from left to right. The LEDs 52 to 56 are provided as the notification members inside the buttons 41 to 45, respectively. It is assumed that the pedals 20 to 24 in the foot controller 3 are arrayed in a straight line in the left-to-right direction. The LEDs 52 to 56 are disposed on the front face of the head 9 in a line that rises from left to right. In other words, the arrangement of the pedals 20 to 24 is different from that of the LEDs 52 to 56 in the left-right direction. The LEDs 52 to 56 are disposed along the housing of the sewing machine 1 on the front face of the head 9 that are located in the vicinity of the sewing position, where the user's attention is focused. The LEDs 52 to 56 have this arrangement because it is well-suited for providing the notifications and is not restricted by the arrangement and the operating positions of the operating members. In the configuration that is described above, the arrangements of the buttons 41 to 45 and the LEDs 52 to 56 differ from the arrangement of the pedals 20 to 24 in that the sewing operations that correspond to the operating members at the same position are different, but the arrangements may also be made the same.

As another modified embodiment of the notification, the sewing apparatus M may also provide the notification in the form of characters or marks that are displayed on the liquid crystal display 72 that is used for explaining the sewing and the selecting of the sewing pattern, for example. The notification is not limited to being a visual notification, and the sewing apparatus M may also provide notification of the operation state with respect to the foot controller 3 by varying other factors that are perceptible to the five senses, such as a sound through a speaker (including the varying of rhythm, wavelength, pitch, length of time that the sound is generated, and the like), wind pressure, wind strength, smell, and the like. In the embodiments that are described above, the sewing apparatus M continues the sewing operation even if the partially depressing state with respect to one of the pedals 20 to 24 is detected, but the sewing apparatus M may also be configured such that the sewing operation is halted in conjunction with the notification. LEDs are used as the light sources (the length emitting members), but other light sources, such as filament lamps, organic EL lamps, and the like, may also be used. The LEDs 52 to 56 are disposed inside the buttons 41 to 45, but they may also be disposed such that they are arrayed alongside the buttons. The number of the LEDs is the same as the number of the pedals 20 to 24, but the notifications may also be provided using one of LED and LCD, each of which is common to a plurality of the pedals 20 to 24. In other words, the configuration may also be simplified by using a number of light emitting members (for example, LEDs) that is less than the number of the pedals 20 to 24. For example, a program may also be configured such that the user can make settings, as necessary, that cause the notifications that pertain to the partial depressing and the full depressing of the pedals 20 to 24 not to be provided.

Figure 11:
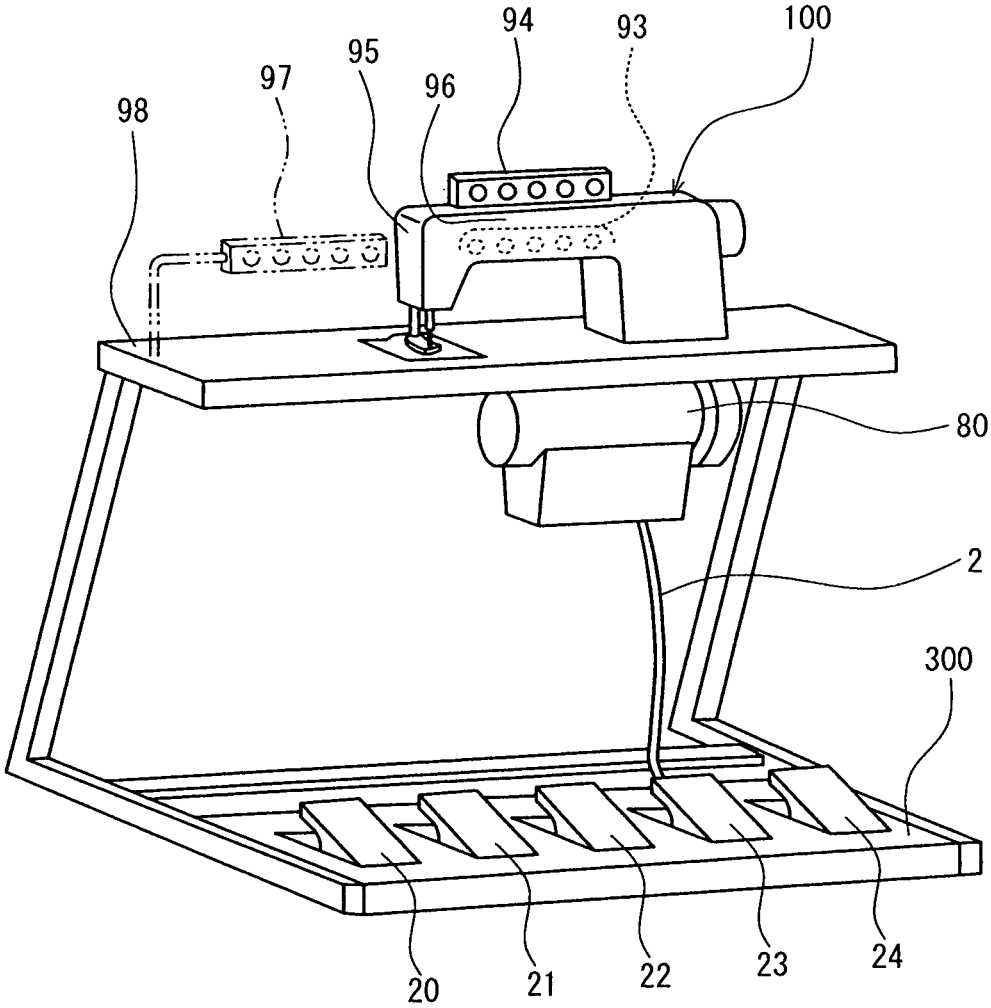
FIG. 11 is an explanatory figure that shows an example of the present disclosure that is implemented in an industrial-use sewing machine.

As shown in FIG. 11, a notification member 93 that provides the notification of the preliminary operation state is not limited to being provided on the front face of a head 95 and may also be provided on the front face of an arm 96. As also shown in FIG. 11, a notification member 94 that provides the notification of the preliminary operation state may also be provided as a member that is attached to the housing of the sewing machine 1 and is separate from the housing (a member that is closer to the sewing position than is any operating member). The position at which the notification member is installed is not limited to the head 95 and the arm 96. In the configuration that is described above, as shown in FIG. 11, a notification device that provides the notification of the preliminary operation state is provided in the sewing machine 1 that is provided with a sewing mechanism, but as long as the user can easily perceive the notification from the notification member, it is not necessary for the notification member to be provided in the housing of the sewing machine 1 itself or in a component that is attached to the housing. For example, a notification member 97 that provides the notification of the preliminary operation state may also be disposed above a table 98 that is within the user's field of view. The position at which the notification member is installed may also be a position that corresponds to one of the pillar and the bed of the housing of the sewing machine 1.

The sewing apparatus M is not limited to a configuration like that described above, in which the relative positions of the sewing machine 1 that is provided with the sewing mechanism and of the foot controller 3 that is provided with the pedals 20 to 24 can be modified. As shown in FIG. 11, the present disclosure may also apply to a configuration in which both of an industrial-use sewing machine 100 that is provided with a sewing mechanism and a foot controller 300 that is provided with the pedals 20 to 24 are fixed to the table 98 to fix the relative position between the industrial-use sewing machine 100 and the foot controller 300. In other words, the present disclosure may also be applied to a sewing apparatus in which the position of the foot controller 300 underneath the sewing position is fixed.

Figure 12:
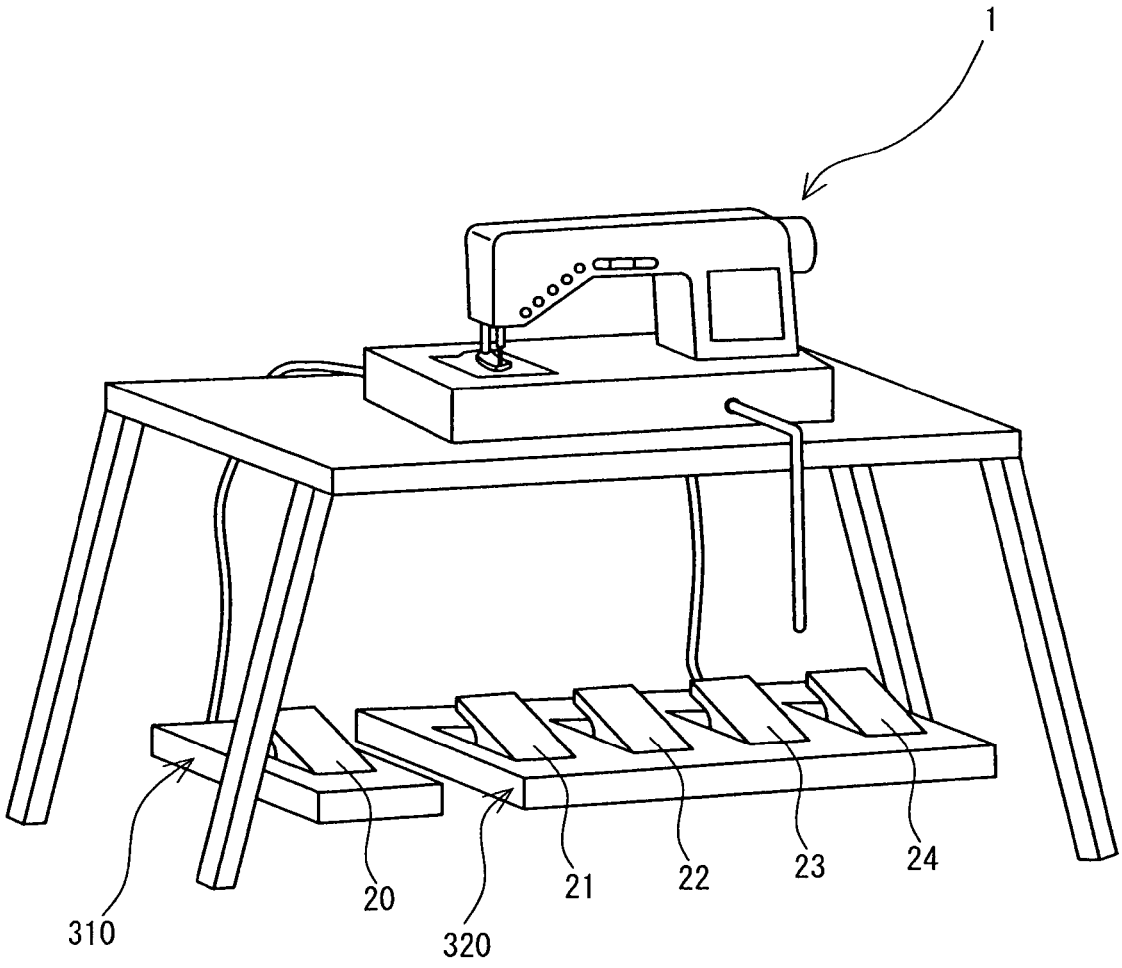
FIG. 12 is an explanatory figure that shows a sewing apparatus in which two foot controller are provided separately.

As a modified embodiment that pertains to the detecting in the configuration that is described above, in the foot controller 3, a plurality of operating members may also be disposed such that they are divided among a plurality of housings, instead of the pedals 20 to 24 that serve as the operating members that are operated by the user's foot and that are all provided in the same housing. For example, the configuration that is shown in FIG. 12 may also be used. In FIG. 12, the operating members are provided in foot controllers 310, 320 that have separate housings.

The embodiment that is described below may be given as another modified embodiment that pertains to the detecting of the operation states with respect to the operating members in the configuration that is described above. In the sewing apparatus M in the embodiment that is described above, the potentiometer 37 that detects the angle at which the pedal 20 is depressed in the foot controller 3 is provided in order to detect the angle at which the pedal 20 is depressed. The sewing machine 1 is configured such that the sewing speed is controlled in accordance with the angle at which the pedal 20 is depressed, and the partial depressing and the full depressing of the pedal 20 can be distinguished based on the detected angle. A switch, for example, may also be provided in addition to the potentiometer 37 in order to the detect the partial depressing of the pedal 20, in the same manner as in the pedals 21 to 24.

As another modified embodiment, two types of switches may also be provided in the pedal 20 instead of the potentiometer 37, one switch to detect the partially depressing state with respect to the pedal 20 and the other switch to detect the fully depressing state with respect to the pedal 20, in the same manner as in the pedals 21 to 24. In this case, the switch for detecting the fully depressing state with respect to the pedal 20 may be set such that its turning from off to on indicates the starting of sewing, and its turning from on to off indicates the stopping of sewing. The foot controller 3 may also be configured such that the user can modify the functions of the pedals 21 to 24 as desired.

A detection shaft of the potentiometer 37 for controlling the speed is disposed such that it is moved by a circular arc-shaped member. The potentiometer 37 may also be configured such that it is operated by a rotating shaft of the pedal 20.

The detection shaft of the potentiometer 37 for controlling the speed is mechanically coupled to the pedal 20 such that the angle of the pedal 20 is constantly detected. The potentiometer 37 may also be disposed such that it is mechanically coupled to the pedal 20 when the amount by which the pedal 20 is depressed is at least a specified amount, and is not mechanically coupled to the pedal 20 when the amount by which the pedal 20 is depressed is less than the specified amount, for example. In other words, the potentiometer 37 may detect the angle of the pedal 20 only when the pedal 20 is depressed by at least the specified amount.

The detection mechanisms that detect a preliminary operation state and an executing operation state are the switches 25 to 32, which have contact points that make contact with the fan-shaped portion P1 that was described earlier. Any one of an optical sensor, a potentiometer, a heat sensor, a sound wave sensor, and a camera (an image capture device) may also be used for detecting a preliminary operation state and an executing operation state.

As another modified embodiment of the configuration that is described above, the operating members that are operated by the user's foot are not limited to being pedals that rotate. For example, the operating members that are operated by the user's foot may also be at least one of buttons and slide members. In another example, the operating members that are operated by the user's foot may also be balls that are rotated. The foot controller 3 in the sewing apparatus M in the configuration that is described above may also have five buttons as the operating members that are operated by the user's foot. Furthermore, the types of the operating members that are provided in the foot controller 3 may also include at least two types, such as pedals and buttons.

A preliminary operation state is defined as a state in which the user is partially depressing one of the pedals 20 to 24, the one of the pedals 20 to 24 actually being rotated to a specified angle, but the definition of a preliminary operation state may be modified. For example, a preliminary operation state may also be defined as an operation state in which the user's foot inadvertently or purposefully is placed on one of the pedals 20 to 24, without the pedal actually being rotated, or as an operation state in which the user's foot inadvertently or purposefully comes within a specified distance from the pedal. In addition, the preliminary operation state may also include an operation state in which an object other than the user inadvertently operates or moves with respect to the operation member before inputting command. The sewing apparatus M may also be provided with a detection device and a control device such that a preliminary operation state is detected as having been performed in a case where the user's foot enters an area that is above one of the pedals 20 to 24. In this case, the light emitting states of the LEDs 52 to 56 are switched by the user's foot coming close to one of the pedals 20 to 24, even if the user does not actually depress one of the pedals 20 to 24. If the light emitting states of the LEDs 52 to 56 are switched, a visual warning is displayed to the user, and inadvertent operation of the pedals 20 to 24 is prevented.

Figure 13:
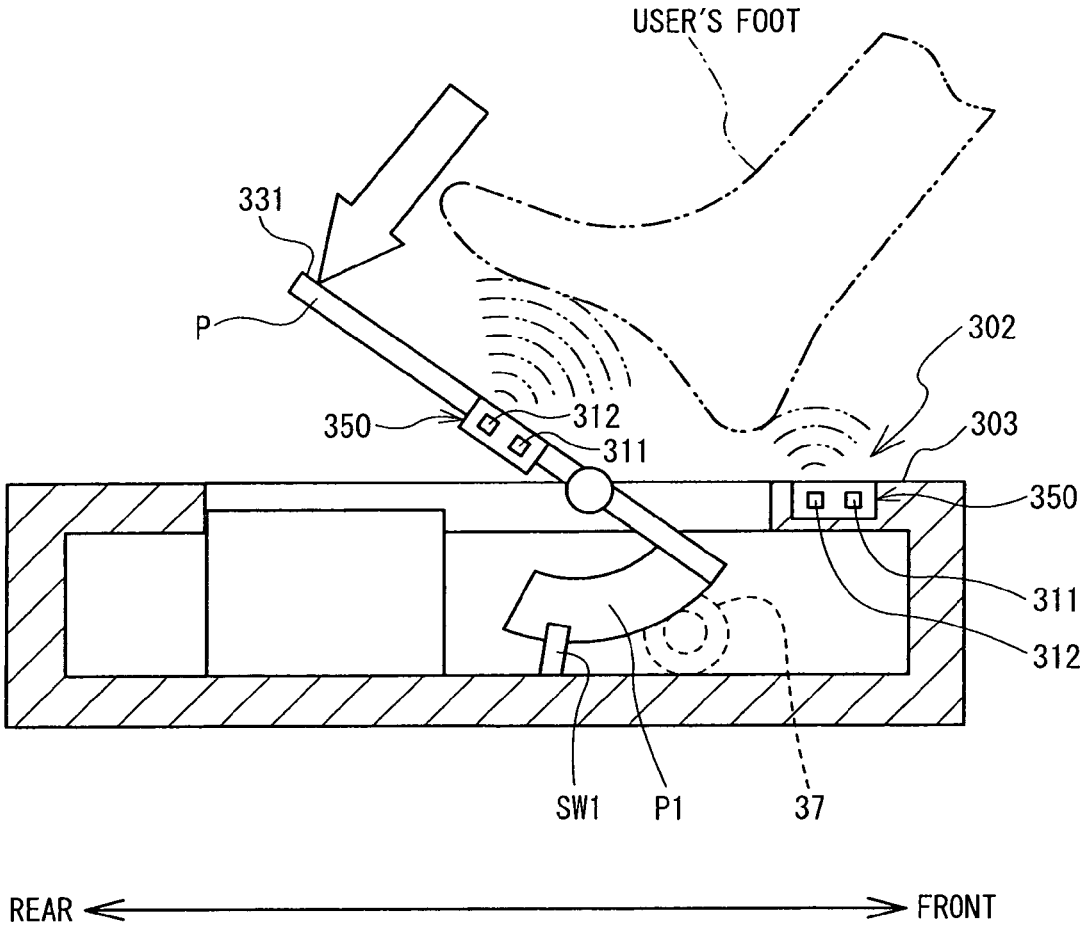
FIG. 13 is an explanatory figure of an operation state detection device that is disposed on a pedal of the foot controller.
Figure 14:
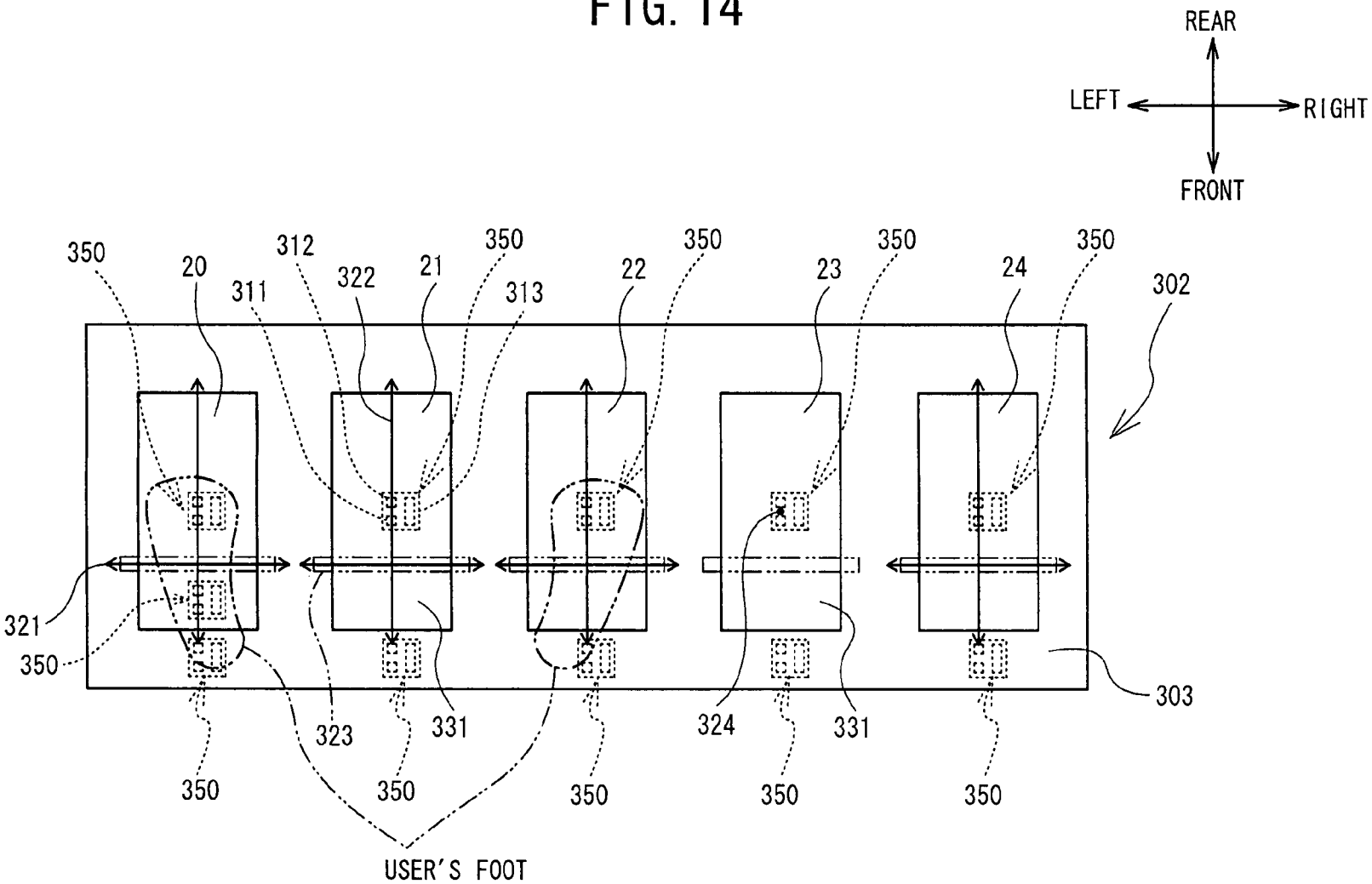
FIG. 14 is a plan view of the foot controller.

For example, as in a foot controller 302 in FIGS. 13 and 14, an operation state detection device 350 may be provided as a device that detects, as a preliminary operation state, an operation state in which the user's foot reaches a position that is no greater than a specified distance from the pedals 20 to 24. The operation state detection device 350 detects a presence of an object in a vicinity of the pedal in which the operation state detection device 350 is installed. The object may be the user's foot, for example. As shown in FIGS. 13 and 14, one of the operation state detection device 350 may be installed in each of the pedals 20 to 24, close to the center of an operating face 331 of the pedal, where a rotating axis direction 321 of the pedal and a direction 322 intersect at right angles.

The operation state detection device 350 may detect the presence of the object in the vicinity of the pedal by using ultrasonic waves, for example. In that case, a device that is provided with a generating portion 311, a emitting portion 312, and a detecting portion 313 may be used as the operation state detection device 350, for example. The generating portion 311 generates the ultrasonic waves. The emitting portion 312 emits the ultrasonic waves that are generated by the generating portion 311 to the outside from the operating face 331 of the pedal P. The detecting portion 313 detects ultrasonic waves (reflected ultrasonic waves) that are reflections of the ultrasonic waves that are emitted from the emitting portion 312 to the outside. As shown in FIG. 13, the ultrasonic waves that are emitted from the emitting portion 312 disperse in the area above the pedal P that is the user side in relation to the pedal P. If the user's foot comes close to the pedal P, the operation state detection device 350, based on the ultrasonic waves emitted from the emitting portion 312 and the reflected ultrasonic waves detected by the detecting portion 313, detects the operation state of the user's foot coming close to the pedal P as a preliminary operation state. The CPU 35 switches the light emitting state of the corresponding one of the LEDs 52 to 56 to the light emitting state that indicates that a preliminary operation state is being detected with respect to the corresponding one of the pedals 20 to 24. The detecting portion 313, in addition to detecting the foot of the person who is using the sewing machine 1, can also detect another person's foot that comes close to the pedal P. In the same manner, the detecting portion 313 can also detect a pet and an object other than a person's foot that come close to the pedal P. In a case where the ultrasonic waves that the generating portion 311 generates are emitted directly to the outside from the foot controller 302, the emitting portion may be incorporated into the generating portion 311 in the operation state detection device 350.

In this modified embodiment, an operation state in which an object such as the user's foot or the like is disposed close to the pedal P is automatically detected by the CPU 35 as the preliminary operation state, based on the result of the detection by the operation state detection device 350. Therefore, the light emitting state of one of the LEDs 52 to 56 is switched at a stage at which the user has not touched one of the pedals 20 to 24. This means that the CPU 35 is capable of detecting whether an operation will be performed on one of the pedals 20 to 24 at an early stage that precedes the contact of the user's foot with the pedal. The sewing apparatus M is therefore capable of preventing the user from operating the pedals 20 to 24 inadvertently. According to the configuration that is described above, even in a case where, for example, an object is unintentionally brought close to one of the pedals 20 to 24, that motion of the object is detected as a preliminary operation state, and the user is notified of the presence of the foreign object. In that case, the user can know of the presence of the foreign object.

As shown in FIG. 14, the operation state detection device 350 is provided in each of the pedals 20 to 24. The CPU 35 is therefore capable of appropriately detecting preliminary operation state with respect to any one of the pedals 20 to 24. That means that the CPU 35 is capable of appropriately switching the light emitting states of the LEDs 52 to 56 that correspond to the operation states with respect to the pedals 20 to 24.

Ordinarily, in a case where the operation state is an executing operation in which the user operates the pedal P in order to input a command for an executing a sewing operation, the user's foot is disposed close to a center 324 of the operating face 331 of the pedal P. As shown in FIG. 14, in a case where the operation state detection device 350 is provided close to the center 324 of the pedal 24, the operation state detection device 350 is capable of accurately detecting the user's foot coming close to the pedal 24.

In a case where the operating member that is used to input a command corresponding to executing operation state, such as one of the pedals 20 to 24, is a member that is capable of rotating around a specified rotating axis 323 as the center of the rotating motion, the user ordinarily disposes a foot in a position that is close to the center of the rotating axis 323. Therefore, in a case where the operation state detection device 350 is provided as shown in FIG. 14, close to the center of the pedal in each of a direction that extends the rotating axis of the pedals 20 to 24 and a direction that is orthogonal to the rotating axis, the operation state detection device 350 is capable of accurately detecting the user's foot coming close to the pedal. In other words, the operation state detection device 350 is provided within the operating face 331 of each of the pedals 20 to 24 in a position where it is highly likely that the user's foot will come close. The CPU 35 is capable of detecting the operation state of the user's foot coming close to one of the pedals 20 to 24 as a preliminary operation state and switching the light emitting state of the corresponding one of the LEDs 52 to 56 to the light emitting state that corresponds to the preliminary operation state.

The operation state detection device 350 may also be provided on the top face of a housing 303 of the foot controller 302, as shown in FIG. 13. In this case, the operation state detection device 350 is not an integral part of an operating member (the pedal P) and does not move, it is not easily affected by an action from the outside.

In a case where the operation state detection device 350 uses ultrasonic waves to detect the presence of an object in the vicinity of the pedal P, the operation state detection device 350 is capable of detecting a preliminary operation state without making contact with the object.

In a case where the emitting portion 312 and the detecting portion 313 of the operation state detection device 350 are disposed in each of the pedals 20 to 24, as shown in FIG. 14, it can be easier to arrange the operation state detection device 350 than in a case where the emitting portion 312 and the detecting portion 313 are placed in separate locations.

Figure 15:
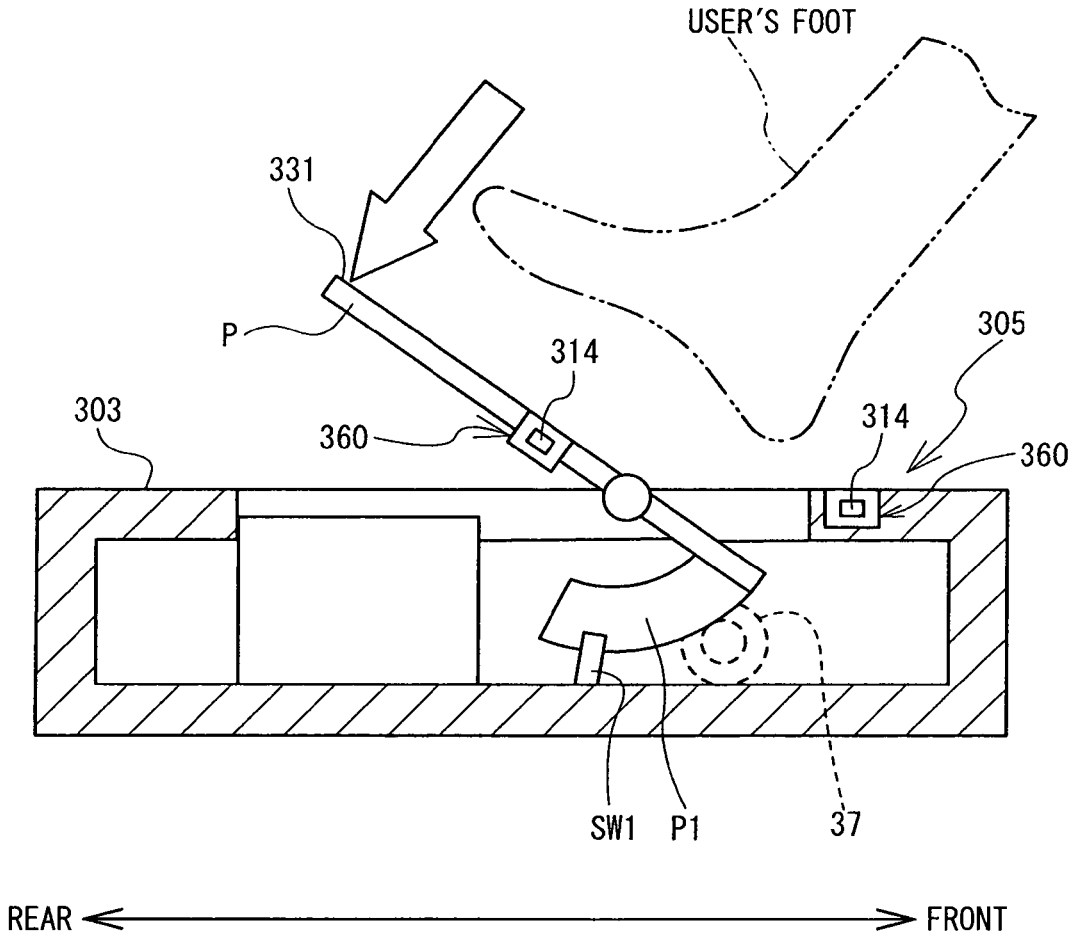
FIG. 15 is an explanatory figure of the operation state detection device that is disposed on the pedal of the foot controller.

As another example, in a foot controller 305 in FIG. 15, an operation state detection device 360 may be provided as a device that detects, as a preliminary operation state, an operation state in which the user's foot reaches a position that is no greater than a specified distance from the pedals 20 to 24. The operation state detection device 360 may be provided with a camera 314 and may detect the presence of an object in the vicinity of the operating member based on an image that is acquired by being captured by the camera 314. For example, the camera 314 is oriented such that it faces in a direction perpendicular to the operating face 331 of the pedal P and captures an image in the direction of the outside of the foot controller 302 from the pedal P. Based on captured image data that are generated by the camera 314, the CPU 35 automatically detects the presence of an object that is disposed in the vicinity of the pedal P. For example, in a case where the user's foot comes close to the pedal P, the CPU 35 may detect the preliminary operation state based on the captured image data and may switch the light emitting state of the corresponding one of the LEDs 52 to 56 to the light emitting state that corresponds to the preliminary operation state. The camera 314 may be installed in at least one of positions where an image can be captured of the area around the pedal P and the pedal P itself. For example, the camera 314 may be installed above the pedal P (for example, on the underside of the table 4) and may capture an image of the area around the pedal P from above. The operation state detection device 360 may also be provided on the top face of a housing 303 of the foot controller 305, as shown in FIG. 15. The camera 314 may capture an image of the area above the pedal P from below. The operation state detection device 360 that is provided with the camera 314 is capable of detecting an object that is positioned in the vicinity of the pedal P, even if the operation state detection device 360 is not in contact with the object, such as the user's foot or the like.

As a modified embodiment of the operation state detection device 350, the operation state detection device 350 may also be a device that uses light to detect the presence of an object in the vicinity of the pedal. In that case, the operation state detection device is provided with a light emitting portion and a light receiving portion. The light emitting portion emits light toward the light receiving portion. The light receiving portion detects the light that the light emitting portion emits. The light receiving portion may be disposed on the underside of the sewing machine table such that it is positioned above the pedals 20 to 24, for example. The light emitting portion may be disposed on any one of the top face of each of the pedals 20 to 24, the top face of the foot controller 3 (the top face of the housing), in which the pedals 20 to 24 are provided, and the floor on which the sewing apparatus M is installed. In a case where the light receiving portion cannot detect the light from the light emitting portion, that is, where the light is blocked by some sort of object (the user's foot or the like), the CPU 35 automatically detects the preliminary operation state. The CPU 35 then switches the light emitting state of the corresponding one of the LEDs 52 to 56 to the state that corresponds to a case where a preliminary operation state with respect to the corresponding one of the pedals 20 to 24 is detected.

In the operation state detection device in which the light receiving device directly detects the light from the light emitting portion, the light receiving device and the light emitting portion are disposed such that they are opposite one another, with an area between them through which it is assumed that the user's foot will pass. For example, the light receiving device may be provided on the operating face 331 of each of the pedals 20 to 24, and the light emitting portion may be provided on the underside of the sewing machine table in positions where it is above the operating face 331 of each of the pedals 20 to 24 and faces the corresponding light receiving device. It is therefore required for the light receiving device and the light emitting portion to be installed precisely. In the case where the emitting portion 312 that emits the ultrasonic waves and the detecting portion 313 that detects the reflected ultrasonic waves are provided in the operation state detection device 350, as well as in the case where the camera 314 is provided in the operation state detection device 360, the operation state detection device 350 and 360 can be disposed on either side of the detected object (for example, the user's foot). In these cases, as described above, it is easier to arrange the operation state detection device than in the case where the light receiving device and the light emitting portion are disposed on either side of the area through which it is assumed that the user's foot will pass.

The operation state detection device 350 and 360 may be disposed such that it can detect the area around the user's foot, taking into account the longitudinal length of the pedal, the material, the shape, the orientation, and the like. The operation state detection device 350 and 360 does not need to be installed for each of the pedals 20 to 24, and it may also be installed for at least one of the pedals 20 to 24. The operation state detection device 350 and 360 may also be installed in combination with at least one of the switches and the potentiometer in the embodiment that is described above.

A single one of the operation state detection device 350 and 360 may also detect the preliminary operation state with respect to a plurality of the pedals 20 to 24. In that case, the light emitting states of the corresponding LEDs 52 to 56 may be switched for all of the pedals 20 to 24 in the vicinities of which objects are detected, for example. It is also permissible, for example, to switch the light emitting state of one of the LEDs 52 to 56 that corresponds to at least one of the pedals 20 to 24 in the vicinities of which objects are detected. For example, it is permissible to switch the light emitting state of the one of the LEDs 52 to 56 that corresponds to the pedal closest to the object, among the plurality of the pedals 20 to 24 in the vicinities of which objects are detected. With respect to the operation state detection device that detects approaching of the user's foot to the pedals 20 to 24, it is not necessary to use the same type of the operation state detection device for all of the plurality of the pedals 20 to 24, and a plurality of types of the operation state detection device 350 and 360 may also be used.

To take another example, looking at the pedals 20 to 24 from above, the area of overlap between the pedal and the object that is within a specified distance (for example, 20 centimeters) from the operating face 331 of the pedal may be determined for each of the pedals, and the light emitting state may be switched for the one of the LEDs 52 to 56 that corresponds to the pedal for which the area of overlap is the greatest. In a case where an object has come within a specified range from a plurality of the pedals 20 to 24, the light emitting states may be switched for the LEDs 52 to 56 that correspond to a top specified number of a plurality of the pedals for which a specified standard (one of relative distance and area of overlap, for example) has been exceeded.

The sewing apparatus M is configured such that signals can be exchanged between the sewing machine 1 and the foot controller 3 through the cable 2, but the signals may also be exchanged by wireless communication (radio waves, optical communication, or the like). A cut-off device may also be provided in order to prevent signals that arise from the pedals 20 to 24 from being transmitted to the sewing machine 1, even when the foot controller 3 is connected to the sewing machine 1. In a case where the signals that are output from the foot controller 3 are not transmitted to the sewing machine 1 due to the cut-off device, the foot controller 3 is in the dormant state. Alternatively, a signal nullification device may also be provided in order to prevent the sewing machine 1 from using, for a sewing operation, any signal that arises from the pedals 20 to 24 and is transmitted to the sewing machine 1 from the foot controller 3. In a case where the signals that are received by the sewing machine 1 are not used due to the signal nullification device, the foot controller 3 is in the dormant state.

In the present embodiment, the pedals 20 to 24 are disposed at almost equal intervals, but the intervals between the pedals 20 to 24 may also vary one by one.

The foot controller 3 as a operating device that is operative to input a command to execute the sewing operation, may also be disposed on top of the table 4 along with the sewing machine 1. In that case, it would still be possible for the user to hold down the work cloth W with one hand, to place the one hand on the work cloth W, to move the work cloth W by the one hand, and to operate the sewing machine 1 by the one hand. It would also be possible for the user to use the other hand to operate the foot controller 3 and the knee lifter bar 5 that are located away from the sewing position.

The arrangements in the left-right direction of the pedals 20 to 24 in the foot controller 3 that are described above and the buttons 41 to 45 that are provided on the front face of the head 9 for the similar sewing operations as the pedals 20 to 24 will be compared. The arrangement of the pedals 20 to 24 and the arrangement of the buttons 41 to 45 for performing the similar sewing operations are made different in consideration of the operability of individual positions. Therefore, the arrangement of the pedals 20 to 24 in the foot controller 3 cannot be surmised from the arrangement of the buttons 41 to 45 on the front face of the head 9. However, as explained previously, the notifications of the partial depressing of any one of the pedals 20 to 24 are provided by the corresponding one of LEDs 52 to 56, so it is possible to prevent the user from inadvertently operating the pedals 20 to 24 by mistake. The left-to-right order of the pedals 20 to 24 in the foot controller 3 and left-to-right order of the buttons 41 to 45 on the front face of the head 9 may also be made the same.

A switch may also be provided that detects, as the preliminary operation state with respect to the knee lifter bar 5, an operation that is performed slightly earlier than the knee lifter switch 51 operates.

In the sewing apparatus M with the configuration that is described above, the presser foot 16 is moved up and down by the force of the presser bar up-and-down motor 84 in accordance with command from the knee lifter switch 51. The sewing apparatus M may also be configured such that the knee lifter switch 51 is omitted and the presser bar up-and-down mechanism moves the presser foot 16 up and down by the force with which the user operates the knee lifter bar 5. As described below, another modified embodiment of a configuration in which the presser foot 16 is moved up and down by the force with which the user operates the knee lifter bar 5 may also be used. An operation state at a stage that precedes the executing operation state that actually starts the presser foot 16 moving is defined as a preliminary operation state. The sewing apparatus M may also be configured such that a switch is provided that detects this preliminary operation state, and notification of the preliminary operation state is provided in the same manner as when the partial depressing of the pedal 24 is detected. In this modified embodiment, a knee lifter bar is not an operating member that inputs a command electrically, but is rather a member that receives the force of the user and transmits the force to the presser bar up-and-down mechanism. The operating members in the present disclosure also encompass the knee lifter bar in this modified embodiment. In other words, an executing operation state is not limited to being the generation of a signal as a command for executing an operation, but also includes the user's application of force through an operating member in order to perform a mechanical operation on a sewing device.

In the embodiment that is described above, the CPU 35 switches the position of the presser bar 17 up and down based on a signal from at least one of the first presser bar up-and-down switch 28, the third presser bar up-and-down switch 50, and the knee lifter switch 51. As a modified embodiment, the CPU 35 may also move the position of the presser bar 17 to any position (an intermediate position) that is between the highest position and the lowest position, in addition to moving it to the highest position and the lowest position.

In concrete terms, the sewing machine 1 may be provided with a sensor that detects the amount of turning of the knee lifter bar 5, for example, and the CPU 35 may raise the presser bar 17 higher as the amount of turning that is detected by the sensor is larger. In another example, the sewing machine 1 may be provided with a sensor that detects the amount by which the pedal 24 is depressed (the rotating angle), and the CPU 35 may raise the presser bar 17 higher as the amount of depressing that is detected by the sensor is larger. The sewing machine 1 may also be provided with a sensor that detects, as an operation amount, one of an amount of movement and the number of times that the button 45 is pressed, for example, and the CPU 35 may raise the presser bar 17 higher as the operation amount that is detected by the sensor is larger.

In the sewing machine 1, the CPU 35 may also stop the presser bar 17 at the intermediate position based on an operation of any one of the knee lifter bar 5, the pedal 24, and the button 45. In the sewing machine 1, the CPU 35 may also stop the presser bar 17 at the intermediate position based only on an operation of one or two of the knee lifter bar 5, the pedal 24, and the button 45, and the CPU 35 may also switch the presser bar 17 vertical two positions, one higher and one lower, based on an operation of the at least one remaining operating member. In other words, the CPU 35 may perform common control of both the raising and lowering of the presser bar 17 based on the operations of the knee lifter bar 5, the pedal 24, and the button 45, it may also perform different control of the raising and lowering according to the type of operation.

The programs for control that are described above are stored in the ROM 36 in advance, but they may also be supplied to the sewing machine 1 through one of an external storage medium and a wired or wireless network.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing apparatus, comprising:

a sewing device that performs sewing on a sewn object;

a first operating device that is operative to input a command to execute an operation of the sewing device;

a first detecting device that detects a preliminary operation state that is an operation state with respect to the first operating device that precedes an executing operation state, the executing operation state being an operation state for inputting the command to execute the operation of the sewing device;

a notifying device that represents any one of at least two states that include a first state that corresponds to the preliminary operation state; and a control device that puts the notifying device into the first state in a case where the preliminary operation state is detected by the first detecting device.

2. The sewing apparatus according to claim 1, further comprising:

a second detecting device that detects the executing operation state with respect to the first operating device, wherein the control device, in a case where the executing operation state is detected by the second detecting device, controls an operation of the sewing device based on the executing operation state.

3. The sewing apparatus according to claim 1, further comprising:

a first housing; and a second housing that is separate from the first housing, wherein the notifying device and the sewing device are provided in the first housing, and the first operating device is provided in the second housing.

4. The sewing apparatus according to claim 1, wherein the first operating device can be operated in a position that is lower than a sewing position where the sewing device performs the sewing on the sewn object, and the notifying device is provided in a position that is higher than the sewing position.

5. The sewing apparatus according to claim 1, wherein the first operating device has a configuration in which the first operating device can enter a dormant state in which the preliminary operation state and the executing operation state are ineffective, and the control device, in a case where the first operating device is in the dormant state, puts the notifying device into a second state that is a state that is different from the first state and is a state that corresponds to the dormant state.

6. The sewing apparatus according to claim 1, wherein the first operating device includes a plurality of first operating members that are respectively associated with a plurality of sewing operations of the sewing device, the notifying device is includes a plurality of notifying members that are respectively associated with the plurality of first operating members, and the control device controls one of the notifying members that is associated with one of the first operating members with which the preliminary operation state is detected by the first detecting device.

7. The sewing apparatus according to claim 6, wherein an arrangement of the plurality of the first operating members is different from an arrangement of the plurality of the notifying members that is based on respective associations of the plurality of the notifying members with the plurality of the first operating members.

8. The sewing apparatus according to claim 2, wherein the first operating device includes a first operating member that is used to input a command to perform at least one of switching of a vertical position of a sewing needle, sewing of a reverse stitch, and cutting of a thread, and the control device, in a case where the executing operation state is detected by the second detecting device, controls the sewing device to perform at least one of the switching of the vertical position of the sewing needle, the sewing of the reverse stitch, and the cutting of the thread, based on the executing operation state.

9. The sewing apparatus according to claim 1, wherein the first operating device includes, as a plurality of first operating members, at least a needle position operating member to switch a vertical position of a sewing needle, a reverse stitch operating member to sew a reverse stitch, and a thread cut operating member to cut a thread, the reverse stitch operating member being disposed between the needle position operating member and the thread cut operating member, the notifying device includes a plurality of notifying members that respectively correspond to the needle position operating member, the reverse stitch operating member, and the thread cut operating member, and the control device puts one of the plurality of the notifying members into the first state, the one of the plurality of the notifying members corresponding to the one of the plurality of first operating members with which the preliminary operation state is detected by first detecting device.

10. The sewing apparatus according to claim 1, further comprising:

a second operating member that is provided in a position that is closer than is the first operating device to a sewing position where the sewing device performs the sewing on the sewn object; and a third detecting device that detects an operation with respect to the second operating member, wherein the control device, in a case where the preliminary operation state with respect to the first operating device is detected by the first detecting device, puts the notifying device into the first state, and in a case where an operation with respect to the second operating member is detected by the third detecting device, puts the notification device into a state that corresponds to the operation with respect to the second operating member.

11. The sewing apparatus according to claim 10, wherein the second operating member is transparent to light, and the notifying device is a light emitting member that is provided in an interior of the second operating member.

12. The sewing apparatus according to claim 1, wherein the first detecting device detects the preliminary operation state based on a presence of an object that is positioned in the vicinity of the first operating device.

13. The sewing apparatus according to claim 1, wherein the first operating device includes an operating surface for inputting the command to execute the operation of the sewing device, and the first detecting device detects the preliminary operation state based on a presence of an object that is positioned in the vicinity of the operating surface in a direction that crosses the operating surface of the first operating device and that is toward an outside of the first operating device from the operating surface.

14. The sewing apparatus according to claim 12, wherein the first operating device includes an operating portion for inputting the command to execute the operation of the sewing device, and the first detecting device is provided in the operating portion of the first operating device.

15. The sewing apparatus according to claim 12, wherein the first operating device includes an operating portion for inputting the command to execute an operation of the sewing device, and the first detecting device is provided close to a center of the operating portion of the first operating device.

16. The sewing apparatus according to claim 12, wherein the first operating device includes an operating portion that can be rotated around a specified axis line as a center of rotation, and the first detecting device is provided close to a center of the operating portion in at least one of a direction that is an extension of the axis line and a direction that is orthogonal to the axis line.

17. The sewing apparatus according to claim 12, wherein the first detecting device detects the presence of the object that is positioned in the vicinity of the first operating device by using ultrasonic waves.

18. The sewing apparatus according to claim 14, wherein the first detecting device includes:

an ultrasonic wave generating portion that generates ultrasonic waves, an ultrasonic wave emitting portion from which the ultrasonic waves generated by the ultrasonic wave generating portion is emitted, and a reflected wave detecting portion that detects reflected ultrasonic waves that are reflections of the ultrasonic waves that are emitted from the ultrasonic wave emitting portion, and the first detecting device detects the presence of the object that is positioned in the vicinity of the first operating device by the ultrasonic waves that are emitted from the ultrasonic wave emitting portion and the reflected ultrasonic waves that are detected by the reflected wave detecting device.

19. The sewing apparatus according to claim 12, wherein the first detecting device includes an image capture device that captures an image of at least one of the first operating device and an area around the first operating device, and the first detecting device detects the presence of the object that is positioned in the vicinity of the first operating device based on an image capture result of the image capture device.

20. A computer-readable medium storing a program, the program comprising instructions that cause a controller to perform the steps of:

detecting a preliminary operation state that is an operation state with respect to a first operating device that is operative to input a command to execute an operation of a sewing device that performs sewing on a sewn object and is an operation that precedes an executing operation state for inputting the command to execute the operation of the sewing device; and putting a notifying device that represent any one of at least two states that include a first state that corresponds to the preliminary operation state into the first state in a case where the preliminary operation state is detected.

* * * * *